US011585073B2

(12) United States Patent
Shike et al.

(10) Patent No.: US 11,585,073 B2
(45) Date of Patent: Feb. 21, 2023

(54) CONSTRUCTION SYSTEM AND CONSTRUCTION METHOD

(71) Applicant: Komatsu Ltd., Tokyo (JP)

(72) Inventors: Chikashi Shike, Tokyo (JP); Ryoichi Togashi, Tokyo (JP); Akinori Onodera, Yokohama (JP)

(73) Assignee: KOMATSU LTD., Tokyo (JP)

( * ) Notice: Subject to any disclaimer, the term of this patent is extended or adjusted under 35 U.S.C. 154(b) by 402 days.

(21) Appl. No.: 16/088,143

(22) PCT Filed: Jun. 6, 2017

(86) PCT No.: PCT/JP2017/021025

§ 371 (c)(1),
(2) Date: Sep. 25, 2018

(87) PCT Pub. No.: WO2017/221692

PCT Pub. Date: Dec. 28, 2017

(65) Prior Publication Data

US 2020/0399864 A1 Dec. 24, 2020

(30) Foreign Application Priority Data

Jun. 21, 2016 (JP) ..... JP2016-123070

(51) Int. Cl.

| | |
|---|---|
| ***E02F 9/26*** | (2006.01) |
| ***E02F 3/43*** | (2006.01) |
| ***E02F 9/20*** | (2006.01) |

(52) U.S. Cl.

CPC ..... *E02F 9/262* (2013.01); *E02F 3/439* (2013.01); *E02F 9/2041* (2013.01); *E02F 9/265* (2013.01)

(58) Field of Classification Search

CPC ..... E02F 3/28

See application file for complete search history.

(56) References Cited

U.S. PATENT DOCUMENTS 6,247,538 B1 6/2001 Takeda et al.
6,823,616 B1 * 11/2004 Gutter ..... E02F 1/00 294/68.23

(Continued)

FOREIGN PATENT DOCUMENTS

CN 103917717 A 7/2014
CN 105324540 A 2/2016

(Continued)

OTHER PUBLICATIONS

Workshop on Characterization and Remediation for Contaminated Sediment Sites, Jun. 15-16, 2011 (Year: 2011).*

(Continued)

*Primary Examiner* — Christian Chace
*Assistant Examiner* — Scott R Jagolinzer
(74) *Attorney, Agent, or Firm* — Locke Lord LLP

(57) ABSTRACT

A construction system includes: a position data acquisition unit configured to acquire position data of a bottom of water; a current-terrain data generation unit configured to generate current terrain data of the bottom of water based on the position data; a target-terrain data generation unit configured to generate target terrain data of the bottom of water based on the current terrain data; and a working equipment control unit configured to control a working equipment of a work vehicle based on the target terrain data.

12 Claims, 17 Drawing Sheets

(56) References Cited

U.S. PATENT DOCUMENTS

| | | | | |
|---|---|---|---|---|
| 8,300,499 | B2 * | 10/2012 | Coleman | G01S 15/8902 367/88 |
| 8,994,519 | B1 * | 3/2015 | Fuchs | G01C 21/3407 340/435 |
| 9,411,325 | B2 | 8/2016 | Baba et al. | |
| 9,551,129 | B2 | 1/2017 | Kami et al. | |
| 9,739,038 | B2 | 8/2017 | Baba et al. | |
| 2006/0122794 | A1 * | 6/2006 | Sprague | G06Q 10/10 702/32 |
| 2008/0133128 | A1 * | 6/2008 | Koch | E02F 9/245 700/229 |
| 2010/0250023 | A1 * | 9/2010 | Gudat | E02F 9/265 701/2 |
| 2014/0288771 | A1 | 9/2014 | Li | |
| 2014/0297040 | A1 | 10/2014 | Baba et al. | |
| 2016/0040398 | A1 | 2/2016 | Kitajima et al. | |
| 2016/0251836 | A1 | 9/2016 | Baba et al. | |
| 2016/0273186 | A1 | 9/2016 | Kami et al. | |
| 2016/0273193 | A1 | 9/2016 | Matsuyama et al. | |
| 2017/0121930 | A1 | 5/2017 | Kitajima et al. | |
| 2018/0171596 | A1 | 6/2018 | Li | |

FOREIGN PATENT DOCUMENTS

| | | | |
|---|---|---|---|
| CN | 105358769 | A | 2/2016 |
| CN | 105636659 | A | 6/2016 |
| JP | 63-114731 | A | 5/1988 |
| JP | H10-88625 | A | 4/1998 |
| JP | 2003/278158 | A | 10/2003 |
| JP | 2006-144388 | A | 6/2006 |
| JP | 2006-249883 | A | 9/2006 |
| JP | 2015-017464 | A | 1/2015 |
| JP | 2016-102312 | A | 6/2016 |
| WO | 2013/099491 | A1 | 7/2013 |
| WO | 2015/030265 | A1 | 3/2015 |

OTHER PUBLICATIONS

Fuglevand et al., Urban River Remediation Dredging Methods That Reduce Resuspension, Release, Residuals, and Risk, 2012, WEDA (Year: 2012).*

Ningxunan, WangJianghui, YangZuoyi and LiuJingyong LiLei, "Application of calculating methods for the dredging amount in a polluted river," World Automation Congress 2012, 2012, pp. 1-4. (Year: 2012).*

H. Kun-jin and N. Fu-sheng, "Research of Dynamic Generation for Terrain and Dredging Cutter," 2009 Second International Conference on Intelligent Computation Technology and Automation, 2009, pp. 884-888, doi: 10.1109/ICICTA.2009.449. (Year: 2009).*

International Search Report dated Sep. 5, 2017, issued for PCT/JP2017/021025.

* cited by examiner

CONSTRUCTION SYSTEM AND CONSTRUCTION METHOD

FIELD

The present invention relates to a construction system and a construction method.

BACKGROUND

For a purpose such as the improvement and control of a river, the water depth securement of a harbor, or the like, dredging is performed with a work vehicle (refer to Patent Literature 1). Dredging means excavating earth and sand on a bottom of water. A bottom of water means a river bed, a river side wall, or sea floor.

CITATION LIST

Patent Literature

Patent Literature 1: Japanese Laid-open Patent Publication No. 2015-017464 A

SUMMARY

Technical Problem

During dredging, an operator operating a work vehicle, has often difficulty in visually observing a bottom of water. Thus, dredging is often performed with recourse to the sense of the operator. The performance of the dredging with recourse to the sense of the operator makes the bottom of water difficult to dredge with high precision.

An object of an aspect of the present invention is to provide a construction system and a construction method that are capable of dredging a bottom of water with high precision.

Solution to Problem

According to a first aspect of the present invention, a construction system comprises: a position data acquisition unit configured to acquire position data of a bottom of water; a current-terrain data generation unit configured to generate current terrain data of the bottom of water, based on the position data; a target-terrain data generation unit configured to generate target terrain data of the bottom of water, based on the current terrain data; and a working equipment control unit configured to control a working equipment of a work vehicle, based on the target terrain data.

According to a second aspect of the present invention, a construction system comprises: a position data acquisition unit configured to acquire position data of a bottom of water; a current-terrain data generation unit configured to generate current terrain data of the bottom of water based on the position data; a target-terrain data generation unit configured to generate target terrain data of the bottom of water; a working equipment control unit configured to control a working equipment of a work vehicle based on the target terrain data; and a display control unit configured to output a display signal to cause a display device to display at least one of the current terrain data and the target terrain data.

According to a third aspect of the present invention, a construction method comprises: acquiring position data of a bottom of water; generating current terrain data of the bottom of water based on the position data; generating target terrain data of the bottom of water based on the current terrain data; and controlling a working equipment of a work vehicle based on the target terrain data.

Advantageous Effects of Invention

According to an aspect of the present invention, there are provided a construction system and a construction method that are capable of dredging a bottom of water with high precision.

DESCRIPTION OF EMBODIMENTS

Embodiments according to the present invention will be described below with reference to the drawings, but the present invention is not limited to this. The respective constituent elements of the embodiments to be described below, can be appropriately combined. In addition, a part of the constituent elements is not necessarily used in some cases.

In the following descriptions, each part in positional relationship will be described with a global coordinate system (XgYgZg coordinate system) and a local coordinate system (XYZ coordinate system) set. The global coordinate system is a coordinate system indicating an absolute position prescribed by a global navigation satellite system (GNSS) such as the global positioning system (GPS). The local coordinate system is a coordinate system indicating a relative position with respect to the reference position of a work vehicle. The XgYg plane including the Xg axis and the Yg axis of the global coordinate system, is parallel to a horizontal plane. The Zg axis is orthogonal to the horizontal plane. The direction parallel to the Zg axis is a vertical direction, and means a height direction or a depth direction in the present embodiment.

First Embodiment (Work Vehicle)

Figure 1:
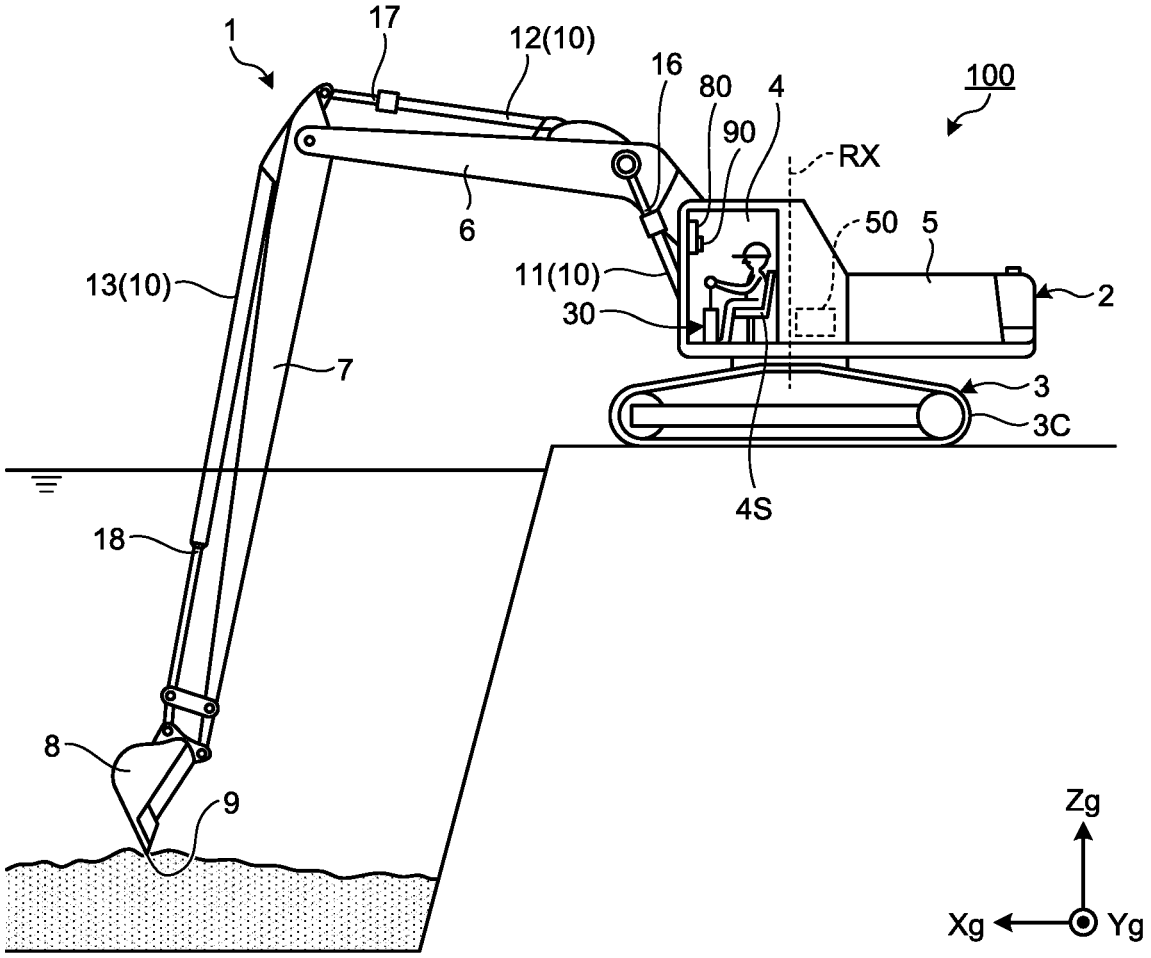
FIG. 1 is a side view illustrating an exemplary work vehicle according to a first embodiment.

FIG. 1 is a side view illustrating an exemplary work vehicle 100 according to the present embodiment. In the present embodiment, an example in which the work vehicle 100 is an excavator, will be described. In the following descriptions, the work vehicle 100 will be appropriately referred to as the excavator 100.

As illustrated in FIG. 1, the excavator 100 includes: a working equipment 1 that operates due to hydraulic pressure; an upper swing body 2 that is a vehicle body supporting the working equipment 1; a lower traveling body 3 that is a traveling device supporting the upper swing body 2; a control device 50 that controls the working equipment 1; and a display device 80.

In the present embodiment, the excavator 100 performs dredging. The excavator 100 inserts the working equipment 1 into water and dredges a bottom of water, with the upper swing body 2 and the lower traveling body 3 located on land. Note that the excavator 100 may insert the working equipment 1 into the water and dredge the bottom of water in a state in which the excavator is located on a boat not illustrated.

The upper swing body 2 has a cab 4 that an operator boards, and a machine room 5 housing an engine and a hydraulic pump. The cab 4 has a cab seat 4S on which the operator sits. The machine room 5 is disposed behind the cab 4.

The lower traveling body 3 has a crawler track 3C. The excavator 100 travels due to rotation of the crawler track 3C. Note that the lower traveling body 3 may have a tire.

The working equipment 1 is supported by the upper swing body 2. The working equipment 1 has: a boom 6 coupled to the upper swing body 2 through a boom pin; an arm 7 coupled to the boom 6 through an arm pin; and a bucket 8 coupled to the arm 7 through a bucket pin. The bucket 8 has a blade edge 9. In the present embodiment, the blade edge 9 of the bucket 8 is the front end portion of a straight blade provided at the bucket 8. Note that the blade edge 9 of the bucket 8 may be the front end portion of a protruding blade provided at the bucket 8.

The working equipment 1 operates due to power generated by a hydraulic cylinder 10. The hydraulic cylinder 10 includes: a boom cylinder 11 that operates the boom 6; an arm cylinder 12 that operates the arm 7; and a bucket cylinder 13 that operates the bucket 8.

The working equipment 1 has: a boom stroke sensor 16 that detects a boom stroke indicating the driving amount of the boom cylinder 11; an arm stroke sensor 17 that detects an arm stroke indicating the driving amount of the arm cylinder 12; and a bucket stroke sensor 18 that detects a bucket stroke indicating the driving amount of the bucket cylinder 13.

The control device 50 includes a computer system. The control device 50 has: a processor such as a central processing unit (CPU); a storage device including a nonvolatile memory such as a read only memory (ROM) and a volatile memory such as a random access memory (RAM); and an input/output interface device.

The display device 80 is disposed in the cab 4. The display device 80 includes a flat-panel display such as a liquid crystal display (LCD) or an organic electroluminescence display (OELD). The operator can visually check the display screen of the display device 80.

(Detection System)

Figure 2:
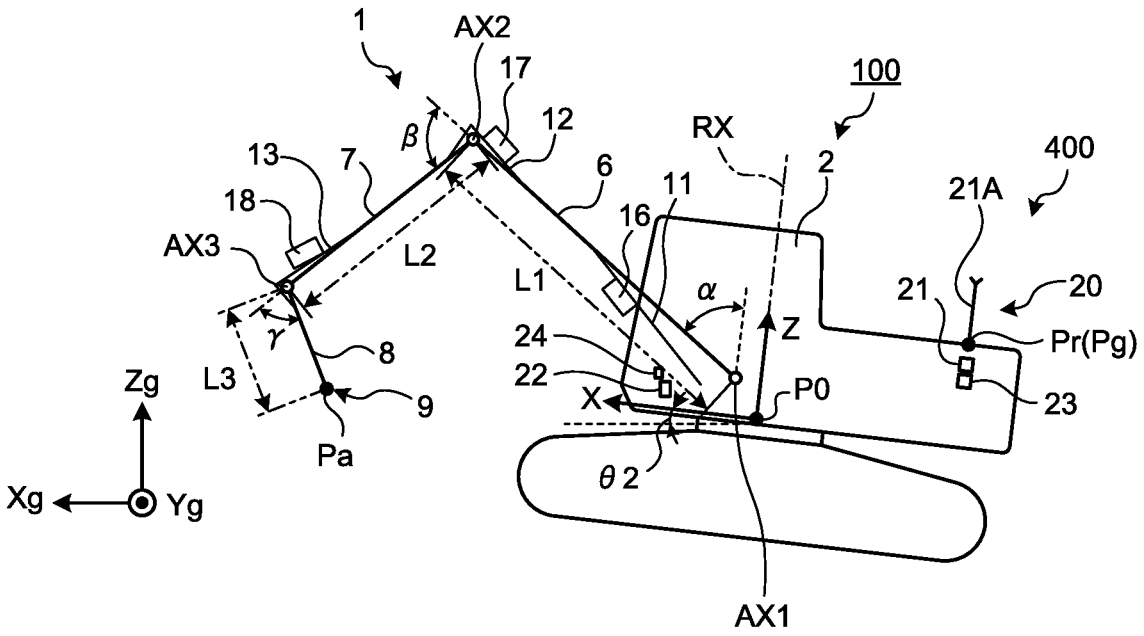
FIG. 2 is a side view schematically illustrating an excavator according to the first embodiment.
Figure 3:
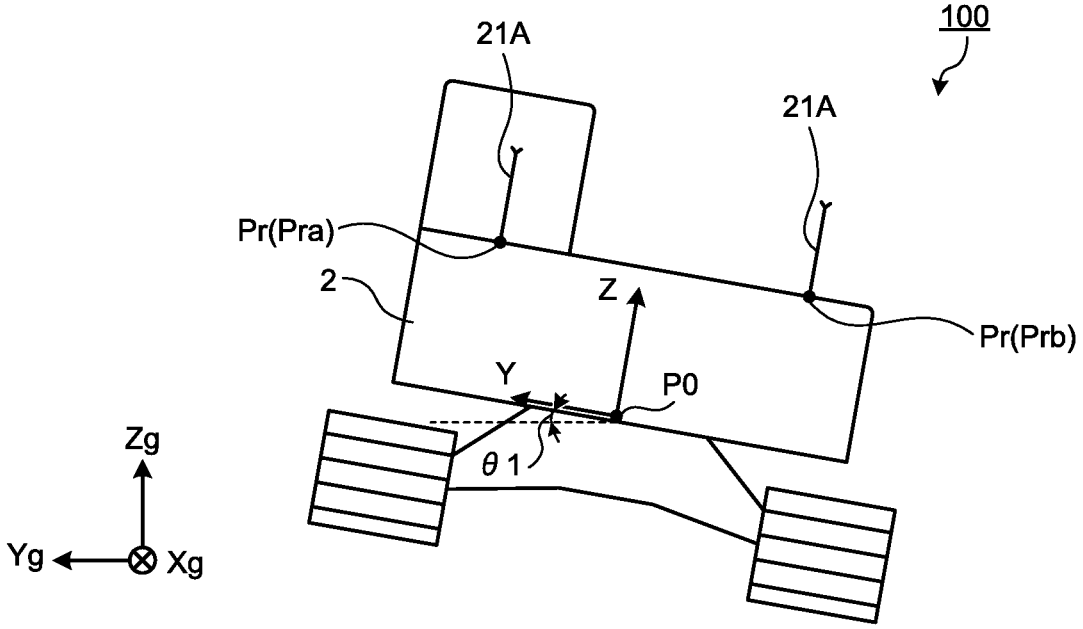
FIG. 3 is a rear view schematically illustrating the excavator according to the first embodiment.
Figure 4:
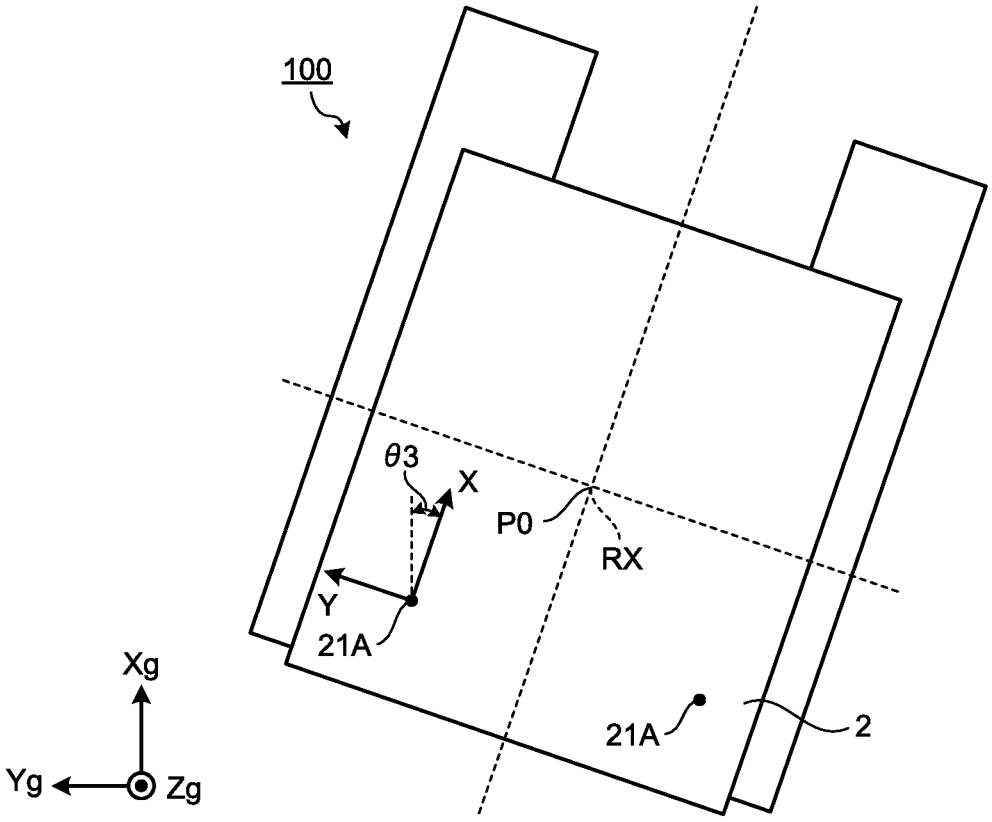
FIG. 4 is a plan view schematically illustrating the excavator according to the first embodiment.

Next, a detection system 400 of the excavator 100 according to the present embodiment, will be described. FIG. 2 is a side view schematically illustrating the excavator 100 according to the present embodiment. FIG. 3 is a rear view schematically illustrating the excavator 100 according to the present embodiment. FIG. 4 is a plan view schematically illustrating the excavator 100 according to the present embodiment.

As illustrated in FIG. 2, the boom 6 is capable of turning around a boom axis AX1 that is a rotational axis, with respect to the upper swing body 2. The arm 7 is capable of turning around an arm axis AX2 that is a rotational axis, with respect to the boom 6. The bucket 8 is capable of turning around a bucket axis AX3 that is a rotational axis, with respect to the arm 7. The boom axis AX1, the arm axis AX2, and the bucket axis AX3 are parallel. The rotational axes AX1, AX2, and AX3 are orthogonal to an axis parallel to a swing axis RX. The rotational axes AX1, AX2, and AX3 are parallel to the Y axis of the local coordinate system. The swing axis RX parallel to the Z axis of the local coordinate system, indicates the up-down direction of the upper swing body 2. The direction parallel to the rotational axes AX1, AX2, and AX3, indicates the vehicle-width direction of the upper swing body 2. The direction orthogonal to both of the rotational axes AX1, AX2, and AX3 and the swing axis RX, indicates the front-back direction of the upper swing body 2. The direction in which the working equipment 1 is located with the operator sitting on the cab seat 4S as a reference, is front.

As illustrated in FIGS. 2, 3, and 4, the detection system 400 has: a position computing device 20 that calculates the position of the upper swing body 2; and a working equipment angle computing device 24 that calculates the angle of the working equipment 1.

The position computing device 20 includes: a vehicle-body position computer 21 that detects the position of the upper swing body 2; an attitude computer 22 that detects the attitude of the upper swing body 2; and an orientation computer 23 that detects the orientation of the upper swing body 2.

The vehicle-body position computer 21 including a GPS receiver, is provided at the upper swing body 2. The vehicle-body position computer 21 detects the absolute position Pg of the upper swing body 2, prescribed by the global coordinate system. The absolute position Pg of the upper swing body 2 includes coordinate data in the Xg-axis direction, coordinate data in the Yg-axis direction, and coordinate data in the Zg-axis direction.

A plurality of GPS antennas 21A is provided at the upper swing body 2. The GPS antennas 21A each receive a radio wave from a GPS satellite and output, to the vehicle-body position computer 21, a signal generated on the basis of the received radio wave. The vehicle-body position computer 21 detects the position Pr at which the GPS antennas 21A are installed, prescribed by the global coordinate system, on the basis of the signal supplied from each GPS antenna 21A, and then detects the absolute position Pg of the upper swing body 2 on the basis of the position Pr.

Two GPS antennas 21A are provided in the vehicle-width direction. The vehicle-body position computer 21 individually detects the position Pra at which one of the GPS antennas 21A is installed and the position Prb at which the other GPS antenna 21A is installed. The vehicle-body position computer 21A performs computation processing, on the basis of at least one of the position Pra and the position Prb, and calculates the absolute position Pg of the upper swing body 2.

The attitude computer 22 includes an inertial measurement unit (IMU). The attitude computer 22 is provided at the upper swing body 2. The attitude computer 22 calculates the inclination angle of the upper swing body 2 with respect to the horizontal plane (XgYg plane) prescribed by the global coordinate system. The inclination angle of the upper swing body 2 with respect to the horizontal plane, includes: a roll angle θ1 indicating the inclination angle of the upper swing body 2 in the vehicle-width direction; and a pitch angle θ2 indicating the inclination angle of the upper swing body 2 in the front-back direction.

The orientation computer 23 calculates the orientation of the upper swing body 2 with respect to a reference orientation prescribed by the global coordinate system, on the basis of the position Pra at which the one GPS antenna 21A is installed and the position Prb at which the other GPS antenna 21A is installed. The reference orientation is, for example, the north. The orientation computer 23 performs computation processing on the basis of the position Pra and the position Prb, and calculates the orientation of the upper swing body 2 with respect to the reference orientation. The orientation computer 23 calculates a straight line connecting the position Pra and the position Prb, and calculates the orientation of the upper swing body 2 with respect to the reference orientation, on the basis of the angle between the calculated straight line and the reference orientation. The orientation of the upper swing body 2 with respect to the reference orientation, includes a yaw angle θ3 indicating the angle between the reference orientation and the orientation of the upper swing body 2.

As illustrated in FIG. 2, the working equipment angle computing device 24 calculates a boom angle α indicating the inclination angle of the boom 6 with respect to the Z axis of the local coordinate system, on the basis of the boom stroke detected by the boom stroke sensor 16. The working equipment angle computing device 24 calculates an arm angle β indicating the inclination angle of the arm 7 with respect to the boom 6, on the basis of the arm stroke detected by the arm stroke sensor 17. The working equipment angle computing device 24 calculates a bucket angle γ indicating the inclination angle of the blade edge 9 of the bucket 8 with respect to the arm 7, on the basis of the bucket stroke detected by the bucket stroke sensor 18.

Note that the boom angle α, the arm angle β, and the bucket angle γ may be detected by an angular sensor provided at the working equipment 1. Alternatively, a stereo camera or a laser scanner may optically detect the angle of the working equipment 10, and the boom angle α, the arm angle β, and the bucket angle γ may be calculated with a result of the detection.

(Ground-Leveling Assist Control)

Figure 5:
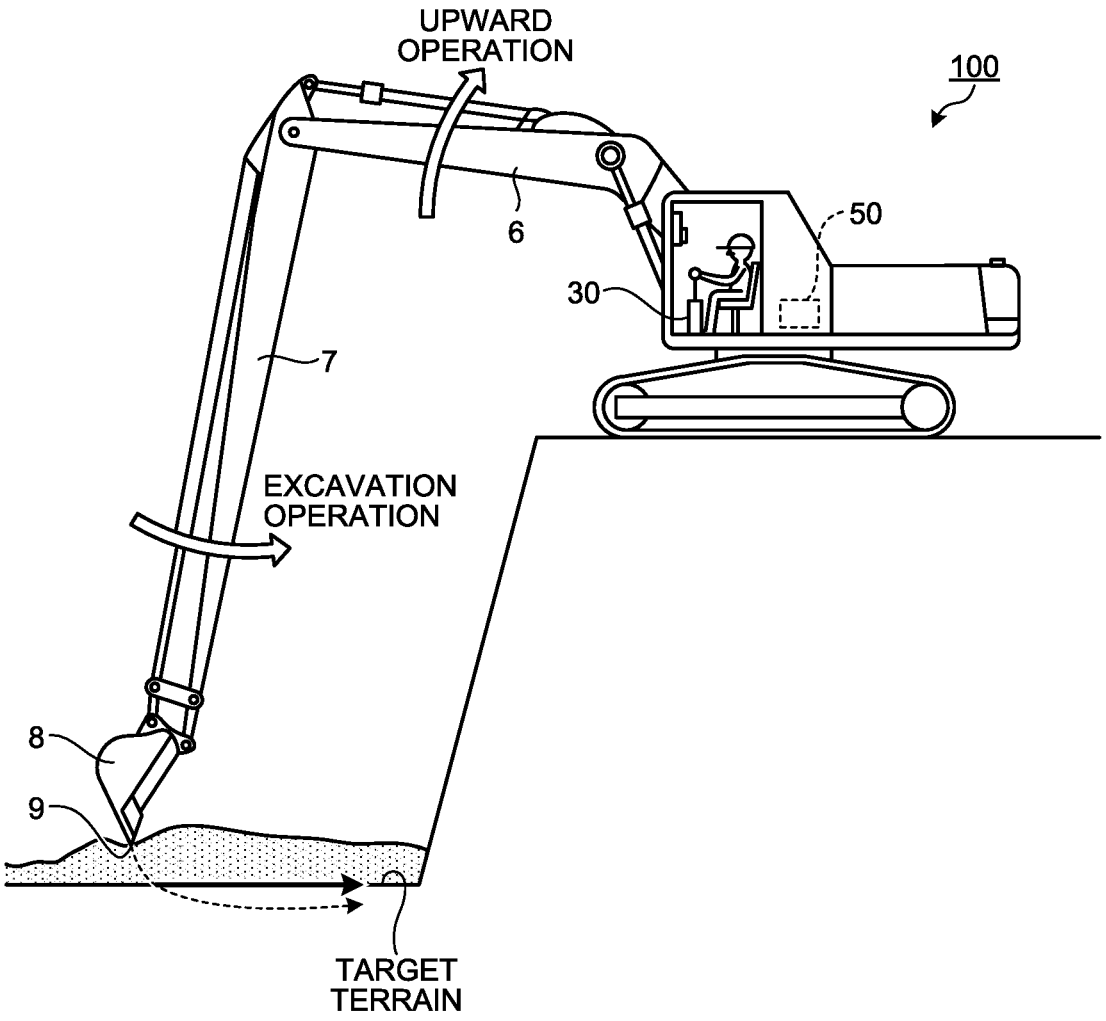
FIG. 5 is a schematic view illustrating the operation of the excavator according to the first embodiment.

FIG. 5 is a schematic view illustrating the operation of the excavator 100 according to the present embodiment. In the present embodiment, the control device 50 performs ground-leveling assist control to the working equipment 1 such that the blade edge 9 of the bucket 8 moves along a target terrain indicating the target shape of an object to be excavated. The control device 50 performs intervention control to the working equipment 1 to perform the ground-leveling assist control.

As illustrated in FIG. 5, in a case where a bottom of water that is the object to be excavated, is excavated, the arm 7 and the bucket 8 are rendered in excavation operation. With the arm 7 and the bucket 8 in the excavation operation due to an operation of an operation device 30, the control device 50 performs the intervention control to the boom 6 such that the blade edge 9 of the bucket 8 moves along the target terrain. In the example illustrated in FIG. 5, the control device 50 controls the boom cylinder 11 such that the boom 6 is rendered in upward operation with the arm 7 and the bucket 8 in the excavation operation. This arrangement performs the intervention control such that the boom 6 is rendered in the upward operation even if the arm 7 and the bucket 8 are rendered in the excavation operation due to the operation of the operator and the blade edge 9 of the bucket 8 attempts to excavate the bottom of water over the target terrain, as indicated with the dotted line of FIG. 5, so that the blade edge 9 of the bucket 8 can move along the target terrain.

The ground-leveling assist control is performed by a hydraulic system having the hydraulic cylinder 10 including the boom cylinder 11, the arm cylinder 12, and the bucket cylinder 13. The hydraulic system has: a spool valve that adjusts the amount of flow of operating oil to be supplied to the hydraulic cylinder 10; a first pilot-pressure control valve that adjusts pilot pressure to be added to the spool valve, in response to the manipulated variable of the operation device 30; and a second pilot-pressure control valve that adjusts pilot pressure to be added to the spool valve, in accordance with the control of the control device 50. In the ground-leveling assist control, the adjustment of the pilot pressure by the second pilot-pressure control valve, has higher priority than the adjustment of the pilot pressure by the first pilot-pressure control valve, does.

(Construction System)

Figure 6:
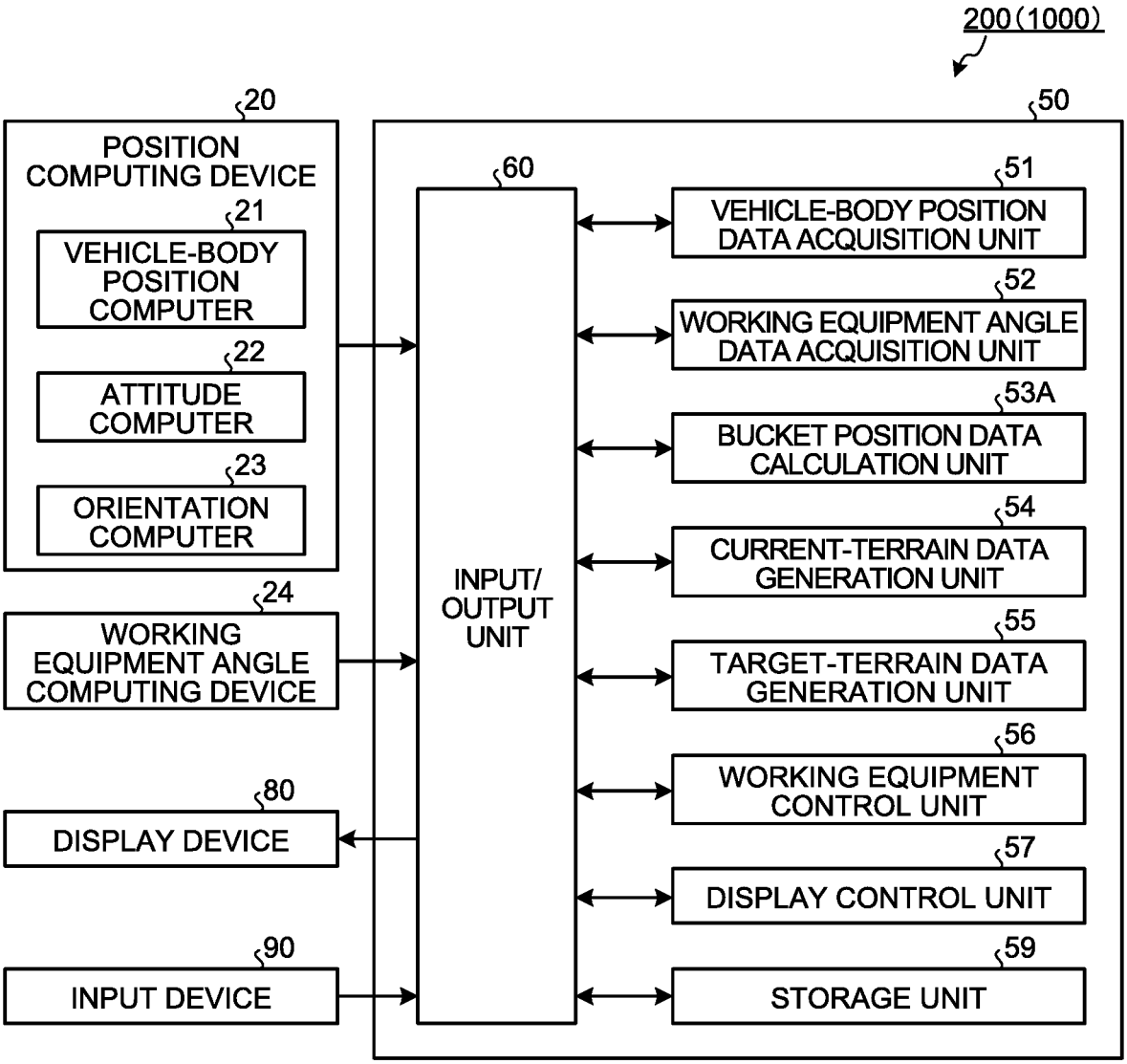
FIG. 6 is a functional block diagram illustrating an exemplary construction system according to the first embodiment.

Next, a construction system 1000 including a control system 200 of the excavator 100, according to the present embodiment, will be described. FIG. 6 is a functional block diagram illustrating an exemplary control system 200 according to the present embodiment.

As illustrated in FIG. 6, the control system 200 includes the control device 50 that controls the working equipment 1, the position computing device 20, the working equipment angle computing device 24, the display device 80, and an input device 90.

The position computing device 20 has the vehicle-body position computer 21, the attitude computer 22, and the orientation computer 23. The position computing device 20 calculates the absolute position Pg of the upper swing body 2, the attitude of the upper swing body 2 including the roll angle θ1 and the pitch angle θ2, and the orientation of the upper swing body 2 including the yaw angle θ3.

The working equipment angle computing device 24 calculates the angle of the working equipment 1 including the boom angle α, the arm angle β, and the bucket angle γ.

The display device 80 displays display data on the basis of a display signal from the control device 50.

The input device 90 operated by the operator, generates and outputs an input signal to the control device 50.

The control device 50 has a vehicle-body position data acquisition unit 51, a working equipment angle data acquisition unit 52, a bucket position data calculation unit 53A, a current-terrain data generation unit 54, a target-terrain data generation unit 55, a working equipment control unit 56, a display control unit 57, a storage unit 59, and an input/output unit 60.

The function of each of the vehicle-body position data acquisition unit 51, the working equipment angle data acquisition unit 52, the bucket position data calculation unit 53A, the current-terrain data generation unit 54, the target-terrain data generation unit 55, the working equipment control unit 56, and the display control unit 57, is achieved by the processor of the control device 50. The function of the storage unit 59 is achieved by the storage device of the control device 50. The function of the input/output unit 60 is achieved by the input/output interface device of the control device 50. The input/output unit 60 connected to the position computing device 20, the working equipment angle computing device 24, the display device 80, and the input device 90, performs data communication with the vehicle-body position data acquisition unit 51, the working equipment angle data acquisition unit 52, the bucket position data calculation unit 53A, the current-terrain data generation unit 54, the target-terrain data generation unit 55, the working equipment control unit 56, the display control unit 57, and the storage unit 59.

The storage unit 59 stores specification data of the excavator 100 including working equipment data. As illustrated in FIG. 2, the working equipment data includes a boom length L1, an arm length L2, and a bucket length L3. The boom length L1 is the distance between the boom axis AX1 and the arm axis AX2. The arm length L2 is the distance between the arm axis AX2 and the bucket axis AX3. The bucket length L3 is the distance between the bucket axis AX3 and the blade edge 9 of the bucket 8.

The vehicle-body position data acquisition unit 51 acquires vehicle-body position data from the position computing device 20 through the input/output unit 60. The vehicle-body position data includes the absolute position Pg of the upper swing body 2 prescribed by the global coordinate system, the attitude of the upper swing body 2 including the roll angle θ1 and the pitch angle θ2, and the orientation of the upper swing body 2 including the yaw angle θ3.

The working equipment angle data acquisition unit 52 acquires working equipment angle data from the working equipment angle computing device 24 through the input/output unit 60. The working equipment angle data includes the boom angle α, the arm angle β, and the bucket angle γ.

The bucket position data calculation unit 53A calculates position data of the bucket 8. In the present embodiment, the bucket position data calculation unit 53A calculates position data of the blade edge 9 of the bucket 8. The bucket position data calculation unit 53A calculates the position data of the blade edge 9 of the bucket 8, on the basis of the vehicle-body position data acquired by the vehicle-body position data acquisition unit 51, the working equipment angle data acquired by the working equipment angle data acquisition unit 52, and the working equipment data stored in the storage unit 59.

The position data of the blade edge 9 of the bucket 8 includes the relative position of the blade edge 9 of the bucket 8 with respect to the reference position P0 of the upper swing body 2. The bucket position data calculation unit 53A can calculate the relative position of the blade edge 9 of the bucket 8 with respect to the reference position P0 of the upper swing body 2, on the basis of the working equipment data including the boom length L1, the arm length L2, and the bucket length L3, and the working equipment angle data including the boom angle α, the arm angle β, and the bucket angle γ. As illustrated in FIG. 2, the reference position P0 of the upper swing body 2 is set on the swing axis RX of the upper swing body 2. Note that the reference position P0 of the upper swing body 2 may be set at any position, such as on the boom axis AX1, in the upper swing body 2.

The position data of the blade edge 9 of the bucket 8 also includes the absolute position of the blade edge 9 of the bucket 8. The bucket position data calculation unit 53A is capable of calculating the absolute position Pa of the blade edge 9 of the bucket 8, on the basis of the absolute position Pg of the upper swing body 2 calculated by the position computing device 20 and the relative position between the reference position P0 of the upper swing body 2 and the blade edge 9 of the bucket 8.

The current-terrain data generation unit 54 generates current terrain data of the bottom of water, on the basis of position data of the bottom of water. The position data of the bottom of water indicates the absolute position of a measurement point of the bottom of water.

In the present embodiment, the position data of the bottom of water includes position data of the working equipment 1 when at least a part of the working equipment 1 is in contact with the measurement point of the bottom of water. In the present embodiment, the position data of the bottom of water includes the position data of the blade edge 9 of the bucket 8 in contact with the bottom of water. In the present embodiment, the bucket position data calculation unit 53A functions as a position data acquisition unit that acquires the position data of the bottom of water.

The current-terrain data generation unit 54 generates the current terrain data of the bottom of water, on the basis of the position data of the blade edge 9 of the bucket 8 in contact with the bottom of water. As described above, the bucket position data calculation unit 53A calculates the absolute position Pa of the blade edge 9 of the bucket 8. The calculation of the absolute position Pa of the blade edge 9 in contact with the measurement point of the bottom of water when the blade edge 9 of the bucket 8 gets in contact with the measurement point of the bottom of water, allows the position data of the bottom of water indicating the absolute position of the measurement point of the bottom of water, to be calculated. The blade edge 9 of the bucket 8 gets in contact with each of a plurality of measurement points of the bottom of water and the absolute position Pa of the blade edge 9 in contact with each of the plurality of measurement points of the bottom of water is calculated, so that the absolute position of each of the plurality of measurement points of the bottom of water is calculated. The current-terrain data generation unit 54 can generate the current terrain data of the bottom of water, on the basis of a plurality of pieces of position data of the bottom of water, indicating the respective absolute positions of the plurality of measurement points of the bottom of water.

The target-terrain data generation unit 55 generates target terrain data of the bottom of water, on the basis of the current terrain data generated by the current-terrain data generation unit 54. The target terrain data of the bottom of water that is target terrain data for dredging of the bottom of water, indicates the target shape of the bottom of water after the dredging. In the present embodiment, the target terrain data is generated from the current terrain data.

The working equipment control unit 56 controls the working equipment 1 of the excavator 100, on the basis of the target terrain data generated by the target-terrain data generation unit 55. In the present embodiment, on the basis of the target terrain data, the working equipment control unit 56 outputs a control signal to the second pilot-pressure control valve described above for the performance of the ground-leveling assist control such that the working equipment 1 dredges the bottom of water. In the present embodiment, the working equipment control unit 56 outputs the control signal and performs the ground-leveling assist control to the working equipment 1 such that the blade edge 9 of the bucket 8 moves along the target terrain of the bottom of water. For example, the output of the control signal to the second pilot-pressure control valve that adjusts the pilot pressure to be added to the spool valve that adjusts the amount of flow of operating oil to be supplied to the boom cylinder 11, may allow the ground-leveling assist control to be performed. For example, the intervention control may be performed such that the boom 6 is rendered in the upward operation so that the blade edge 9 of the bucket 8 moves along the target terrain data.

The display control unit 57 outputs, to the display device 80, the display signal that causes the display device 80 to display at least one of the current terrain data of the bottom of water generated by the current-terrain data generation unit 54 or the target terrain data generated by the target-terrain data generation unit 55.

(Construction Method)

Figure 7:
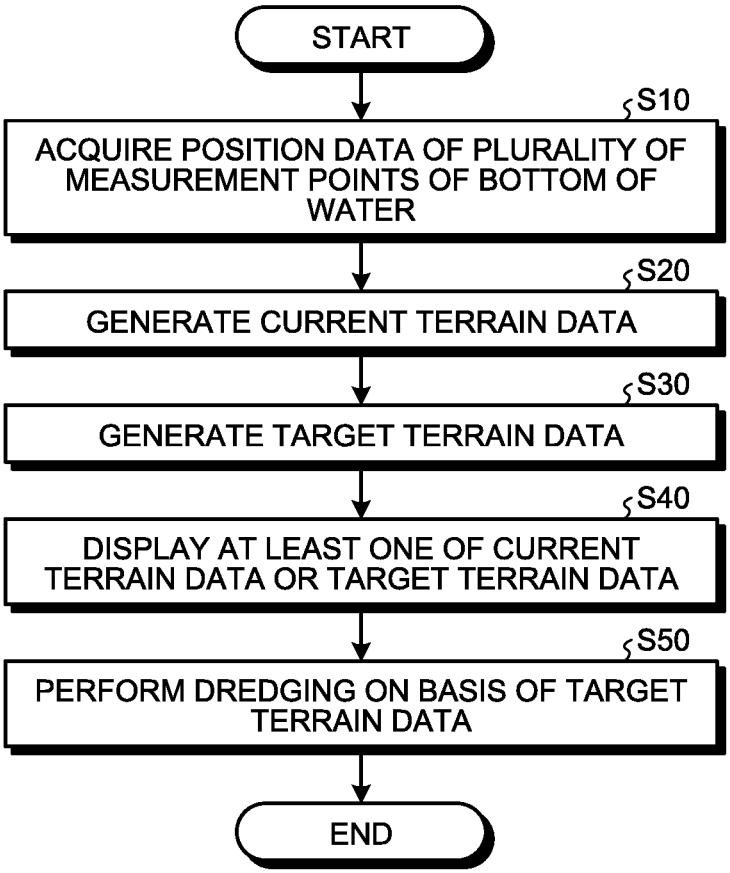
FIG. 7 is a flowchart illustrating an exemplary construction method according to the first embodiment.

Next, an exemplary construction method with the excavator 100 according to the present embodiment, will be described. FIG. 7 is a flowchart illustrating the exemplary construction method according to the present embodiment.

The operator operates the operation device 30 to insert the working equipment 1 into water. The position data of a plurality of measurement points of the bottom of water is acquired with the bucket 8 (Step S10).

Figure 8:
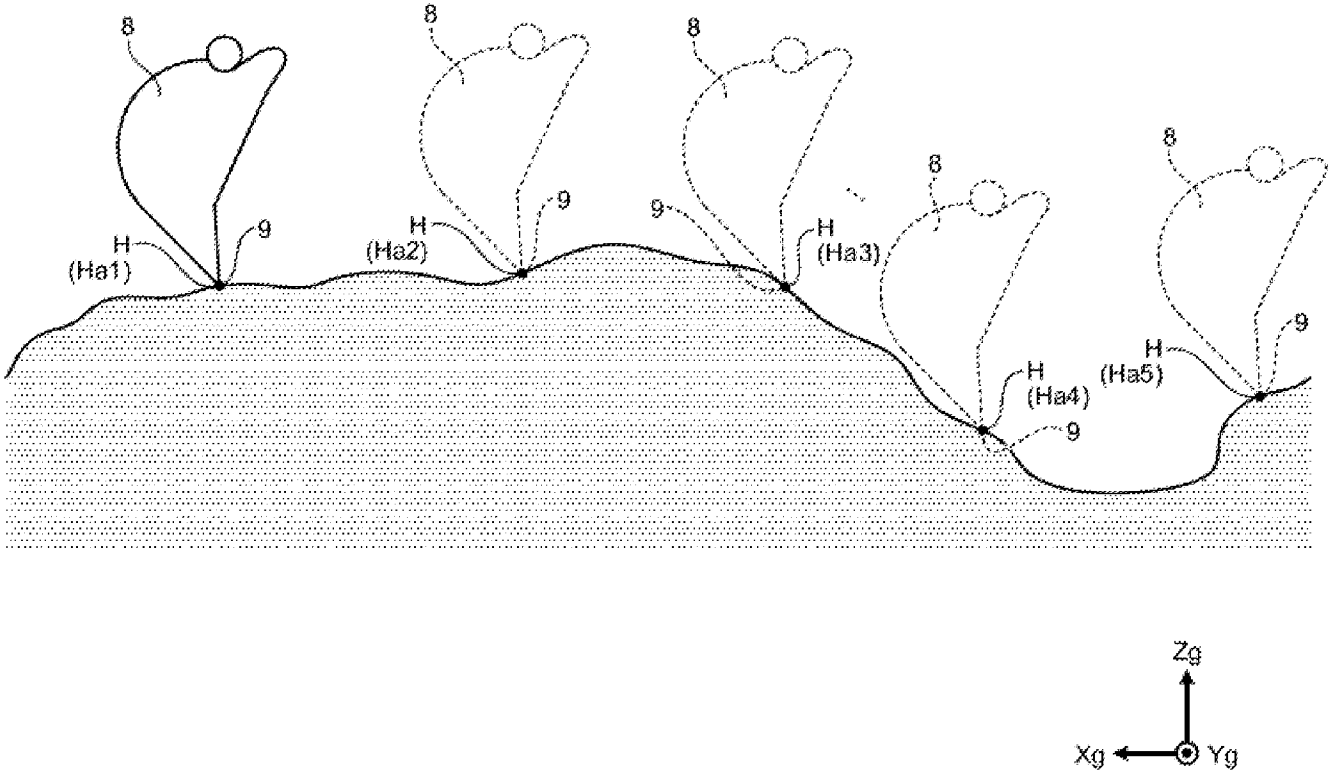
FIG. 8 is a schematic view illustrating an exemplary method of acquiring position data of a bottom of water, according to the first embodiment.

FIG. 8 is a schematic view illustrating an exemplary method of acquiring the position data of the bottom of water, according to the present embodiment. The operator operates the operation device 30 such that the blade edge 9 of the bucket 8 is in contact with the bottom of water. In general, the operator in the cab 4 has often difficulty in visually observing the bottom of water due to, for example, the transparency of water, a water depth, and the reflection of light on a water surface. The blade edge 9 changes from a contact state with the bottom of water to a non-contact state with the bottom of water, so that impulse acts on the operator through the working equipment 1. The impulse enables the operator to determine whether or not the blade edge 9 is in contact with the bottom of water.

When determining that the blade edge 9 is in contact with a measurement point H of the bottom of water (for example, a measurement point Ha1), the operator stops operating the operation device 30, stops the movement of the working equipment 1, and operates the input device 90. An input signal generated by the operation of the input device 90, is output to the bucket position data calculation unit 53A. The bucket position data calculation unit 53A calculates position data indicating the absolute position Pa of the blade edge 9 of the bucket 8 in the acquisition of the input signal.

The calculation of the absolute position Pa of the blade edge 9 in contact with the measurement point Ha1 of the bottom of water when the blade edge 9 of the bucket 8 gets in contact with the measurement point Ha1 of the bottom of water, allows the position data of the bottom of water indicating the absolute position of the measurement point Ha1 of the bottom of water, to be acquired. The position data of the measurement point Ha1 of the bottom of water, is stored in the storage unit 59.

After the acquisition of the position data of the measurement point Ha1 of the bottom of water, the operator operates the operation device 30 such that the blade edge 9 of the bucket 8 is in contact with a measurement point Ha H of the bottom of water (for example, a measurement point Ha2) different from the measurement point Ha1. When determining that the blade edge 9 is in contact with the measurement point Ha2 of the bottom of water, the operator stops operating the operation device 30 and operates the input device 90, so that the position data of the bottom of water indicating the absolute position of the measurement point Ha2 of the bottom of water, is calculated similarly to the measurement of the measurement point Ha1. The position data of the measurement point Ha2 of the bottom of water, is stored in the storage unit 59.

The operator repeats the operation described above a plurality of times. This arrangement allows the position data of each of a plurality of different measurement points H of the bottom of water, to be acquired and stored into the storage unit 59.

In the present embodiment, the working equipment 1 is extended and contracted with the lower traveling body 3 substantially stopped and swing of the upper swing body 2 substantially stopped, so that the position data of the plurality of measurement points H (Ha1, Ha2, . . . , Hai) is acquired. In other words, with the lower traveling body 3 substantially stopped and swing of the upper swing body 2 substantially stopped, the blade edge 9 of the bucket 8 is moved in the XZ plane including the X axis and the Z axis of the local coordinate system and the position data in the Zg-axis direction (depth direction) of the global coordinate system at each of the plurality of measurement points H in the X-axis direction (front-back direction), is acquired. For example, the operator operates the operation device 30 and drives the working equipment 1 such that intervals are constant between the plurality of measurement points H (Ha1, Ha2, . . . , Hai) in the X-axis direction.

After the acquisition of the position data of the plurality of measurement points H of the bottom of water, the current-terrain data generation unit 54 generates the current terrain data of the bottom of water, on the basis of the position data of the plurality of measurement points H of the bottom of water (Step S20).

Figure 9:
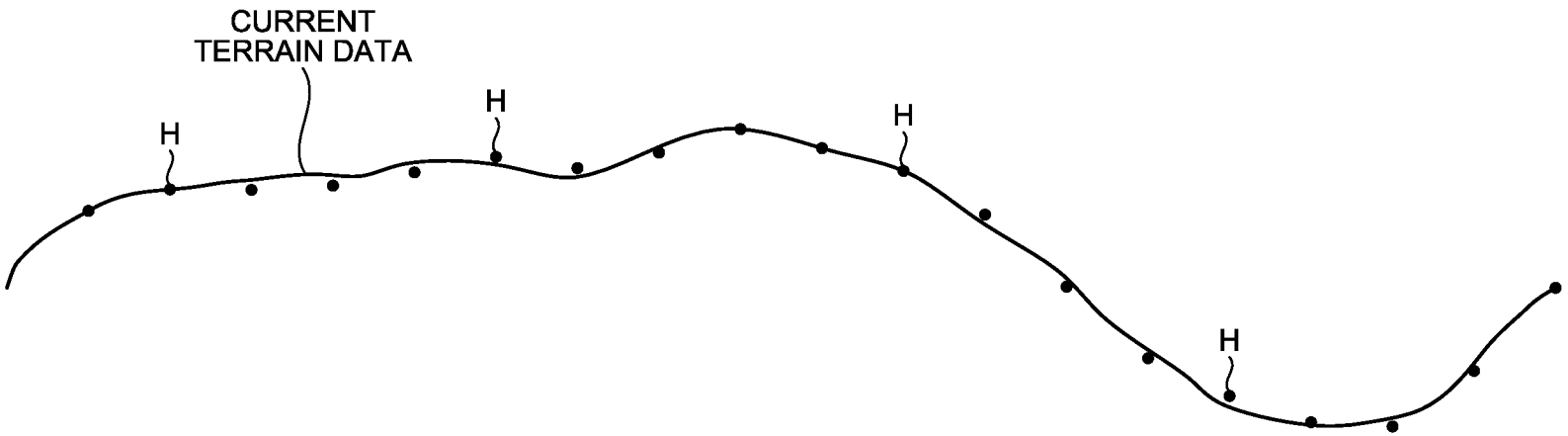
FIG. 9 is a schematic view illustrating an exemplary method of generating current terrain data of the bottom of water, according to the first embodiment.

FIG. 9 is a schematic view illustrating an exemplary method of generating the current terrain data of the bottom of water, according to the present embodiment. For example, the current-terrain data generation unit 54 performs curve-fitting processing, on the basis of the position data of the plurality of measurement points H of the bottom of water, and generates the current terrain data of the bottom of water. In the present embodiment, the current terrain data of the bottom of water in the swing area of the upper swing body 2, is generated.

After the generation of the current terrain data, the target-terrain data generation unit 55 generates the target terrain data for dredging of the bottom of water, on the basis of the current terrain data (Step S30).

Figure 10:
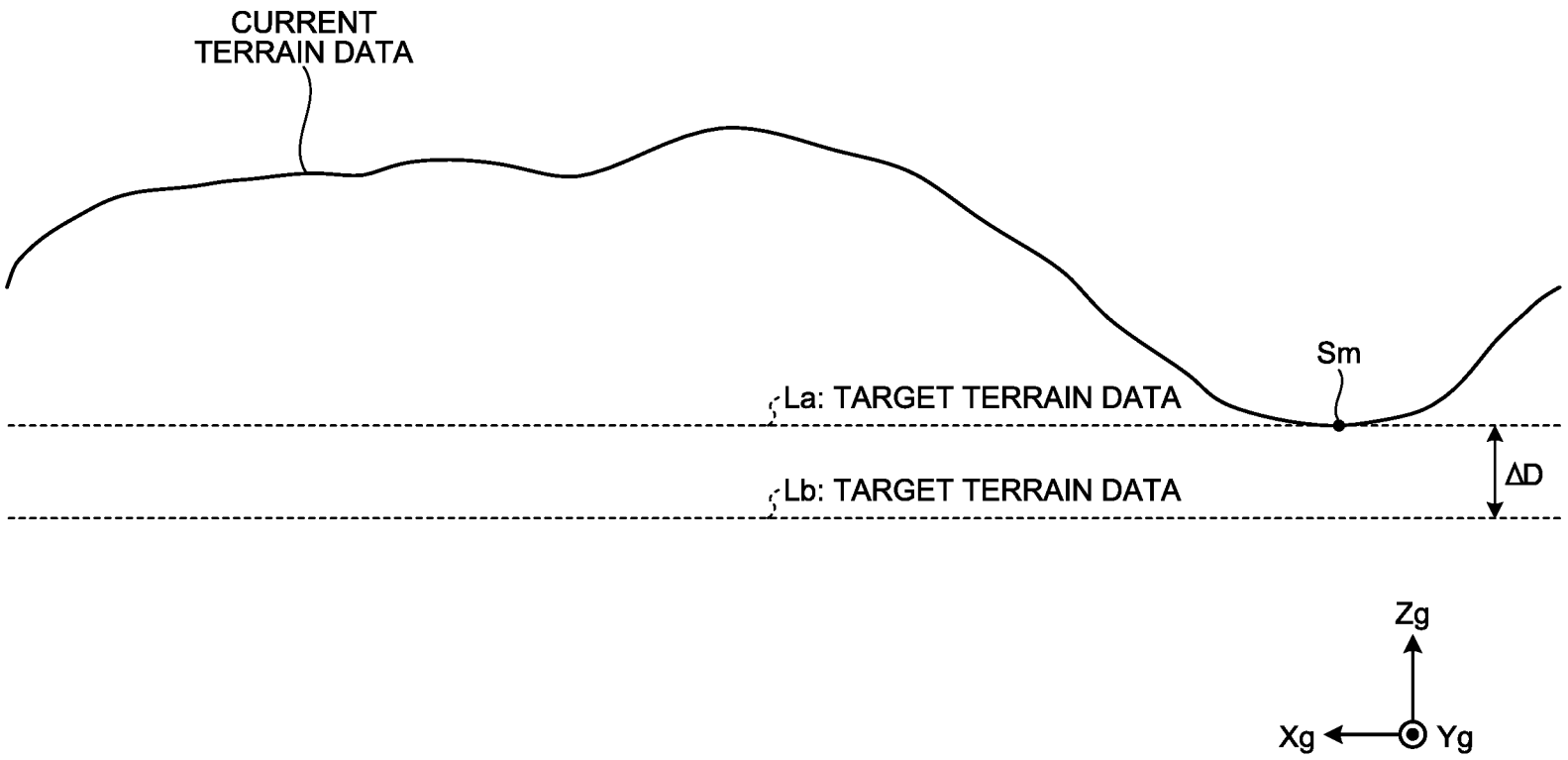
FIG. 10 is a schematic view illustrating an exemplary method of generating target terrain data of the bottom of water, according to the first embodiment.

FIG. 10 is a schematic view illustrating an exemplary method of generating the target terrain data of the bottom of water, according to the present embodiment. In the present embodiment, the target-terrain data generation unit 55 generates the target terrain data, on the basis of the position data indicating the absolute position of a deepest site Sm in the current terrain data. For example, a plane La that passes through the site Sm and is parallel to the horizontal plane, is set as the target terrain. Note that the target terrain may be a plane Lb that passes through a site deeper than the site Sm by ΔD and is parallel to the horizontal plane.

Figure 11:
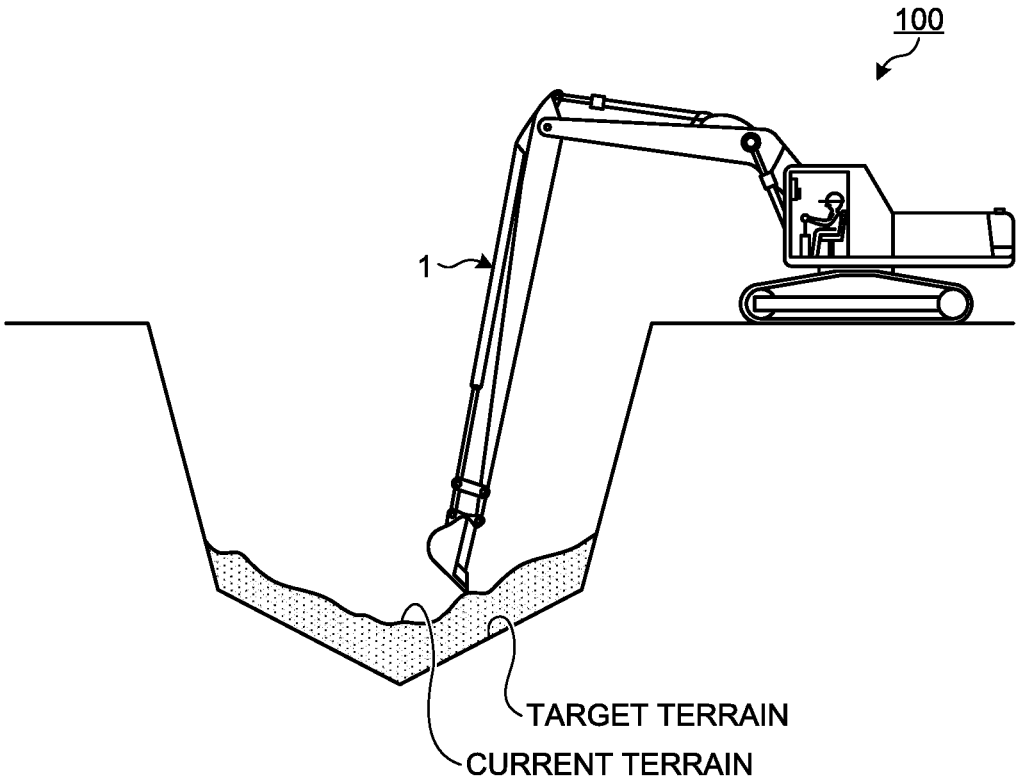
FIG. 11 is a schematic view illustrating an exemplary method of generating target terrain data of the bottom of water, according to the first embodiment.

Note that the target terrain may be a plane that passes through the site Sm and inclines with respect to the horizontal plane, or a plane that passes through the site deeper than the site Sm by ΔD and inclines with respect to the horizontal plane. For example, as illustrated in FIG. 11, in a river having a center portion deepest in water depth and both end portions shallow in water depth, setting the target terrain as a plane inclining with respect to the horizontal plane causes earth and sand depositing on the bottom of water, to be removed, so that a state before the deposition of the earth and sand can be restored.

After the generation of the current terrain data and the generation of the target terrain data, the display control unit 57 outputs, to the display device 80, the display signal that causes the display device 80 to display at least one of the current terrain data or the target terrain data (Step S40).

Figure 12:
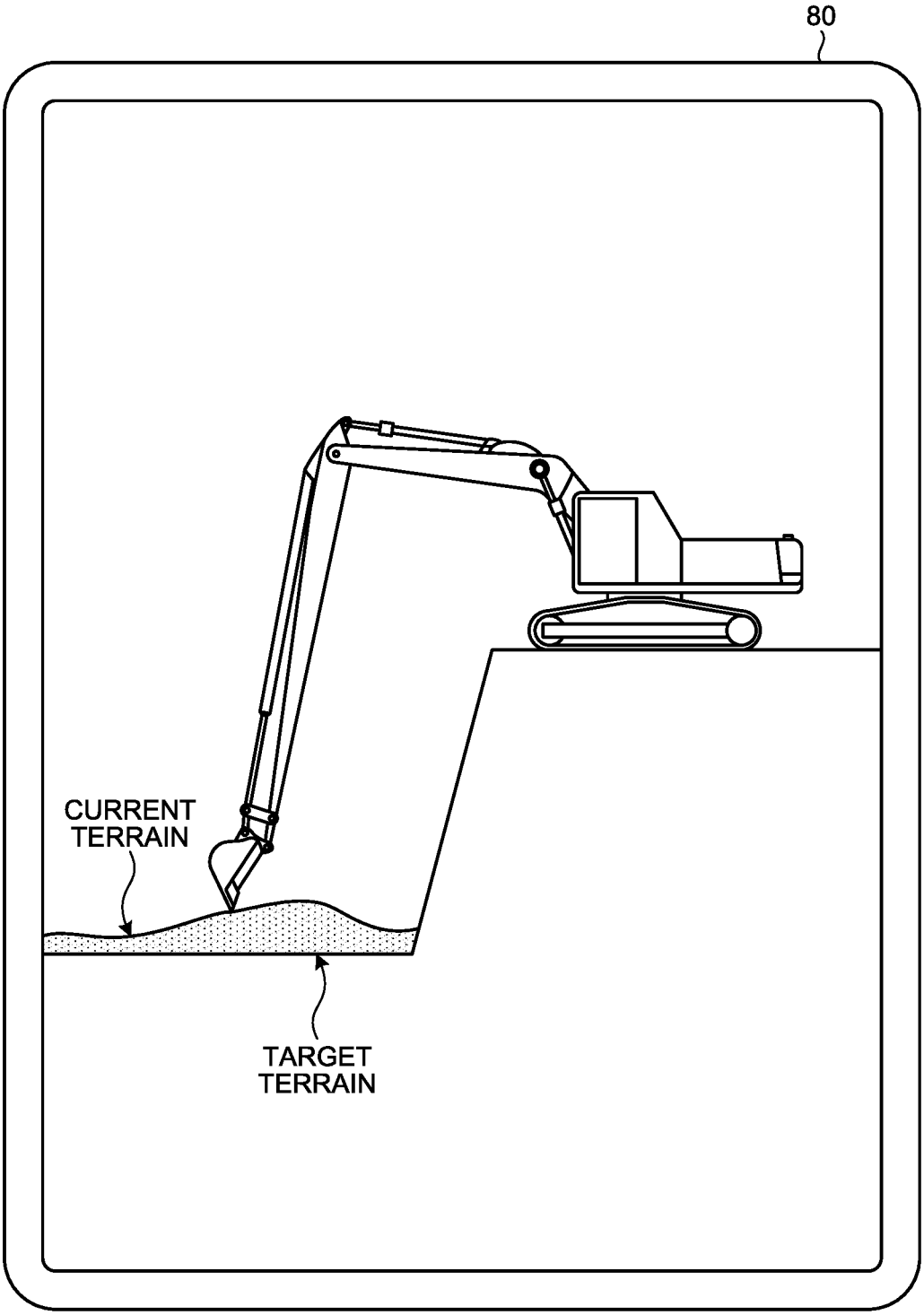
FIG. 12 is a schematic view illustrating an exemplary display device according to the first embodiment.

FIG. 12 is a schematic view of an exemplary display device 80 according to the present embodiment. As illustrated in FIG. 12, the display control unit 57 causes the display device 80 to display at least one of the current terrain data or the target terrain data. FIG. 12 illustrates the example in which both of the current terrain data and the target terrain data are displayed on the display device 80. The display of the current terrain data and the target terrain data by the display device 80, enables the operator to visually check the current terrain generated by the current-terrain data generation unit 54 and the target terrain generated by the target-terrain data generation unit 55.

After the generation of the target terrain data, on the basis of the target terrain data, the working equipment control unit 56 outputs the control signal such that the working equipment 1 of the excavator 100 dredges the bottom of water (Step S50). That is, the control system 200 performs the ground-leveling assist control such that the blade edge 9 of the bucket 8 moves along the target terrain.

In the present embodiment, the target terrain data is two-dimensional data generated in the XZ plane of the local coordinate system, similarly to the current terrain data. That is, in the present embodiment, the piece of current terrain data and the piece of target terrain data each are linear data prescribed in the XZ plane. The linear target terrain data is generated in the XZ plane after the generation of the linear current terrain data in the XZ plane with the movement of the blade edge 9 of the bucket 8 in the XZ plane of the local coordinate system with the lower traveling body 3 substantially stopped and swing of the upper swing body 2 substantially stopped. After moving the working equipment 1 in order to generate the current terrain data, without moving the lower traveling body 3 and the upper swing body 2, the excavator 100 can perform the ground-leveling assist control to move the working equipment 1 on the basis of the target terrain data, without moving the lower traveling body 3 and the upper swing body 2. In other words, after performing the operation of extending and contracting the working equipment 1 in order to generate the current terrain data, the excavator 100 can perform transition to the ground-leveling assist control without moving the lower traveling body 3 and the upper swing body 2.

Note that, after the acquisition of the position data of the plurality of measurement points Ha H (Ha1,Ha2, . . . , Hai), the operator may perform processing similar to that described above, with the orientation of the upper swing body 2 changed by swinging the upper swing body 2 slightly. That is, after performing the processing of acquiring the position data of the plurality of measurement points H (Ha1, Ha2, . . . , Hai) by extension and contraction of the working equipment 1 with the upper swing body 2 facing a first orientation, the operator may perform the processing of acquiring the position data of a plurality of measurement points H (Hb1, Hb2, . . . , Hbi) by extension and contraction of the working equipment 1 with the upper swing body 2 facing a second orientation different from the first orientation. With the upper swing body 2 facing each of the plurality of orientations, the processing of acquiring the position data of the plurality of measurement points H (Ha, Hb) by the extension and contraction of the working equipment 1 in each of the orientations, is performed.

With the upper swing body 2 facing each of the plurality of orientations, the performance of the processing of acquiring the position data of the plurality of measurement points H by the extension and contraction of the working equipment 1 in each of the orientations, generates three-dimensional current terrain data. Note that the position data between measured measurement points may be subjected to interpolation processing, on the basis of an interpolation method such as the bilinear method.

The three-dimensional current terrain data may be generated on the basis of the position data of a plurality of measurement points H acquired by extension and contraction of the working equipment 1 with the upper swing body 2 swinging but the lower traveling body 3 not moving. In this case, the position data of the measurement points H of the bottom of water in the swing area of the upper swing body 2, is acquired. The swing area of the upper swing body 2 is an area in which the bucket 8 can perform construction (excavation) with the working equipment 1 maximally extended.

Note that, after the acquisition of the position data of the plurality of measurement points H by the extension and contraction of the working equipment 1, traveling of the lower traveling body 3 changes the position of the excavator 100 and the position data of a plurality of measurement points H may be acquired by extension and contraction of the working equipment 1 at the changed position of the excavator 100. Even in the case where the lower traveling body 3 travels and the position data of the plurality of measurement points H is acquired, the position data between measured measurement points, may be subjected to interpolation processing, on the basis of an interpolation method such as the bilinear method.

In addition, the target terrain data may be generated on the basis of the three-dimensional current terrain data. In this case, three-dimensional target terrain data is generated. The ground-leveling assist control is performed on the basis of the three-dimensional target terrain data.

Figure 13:
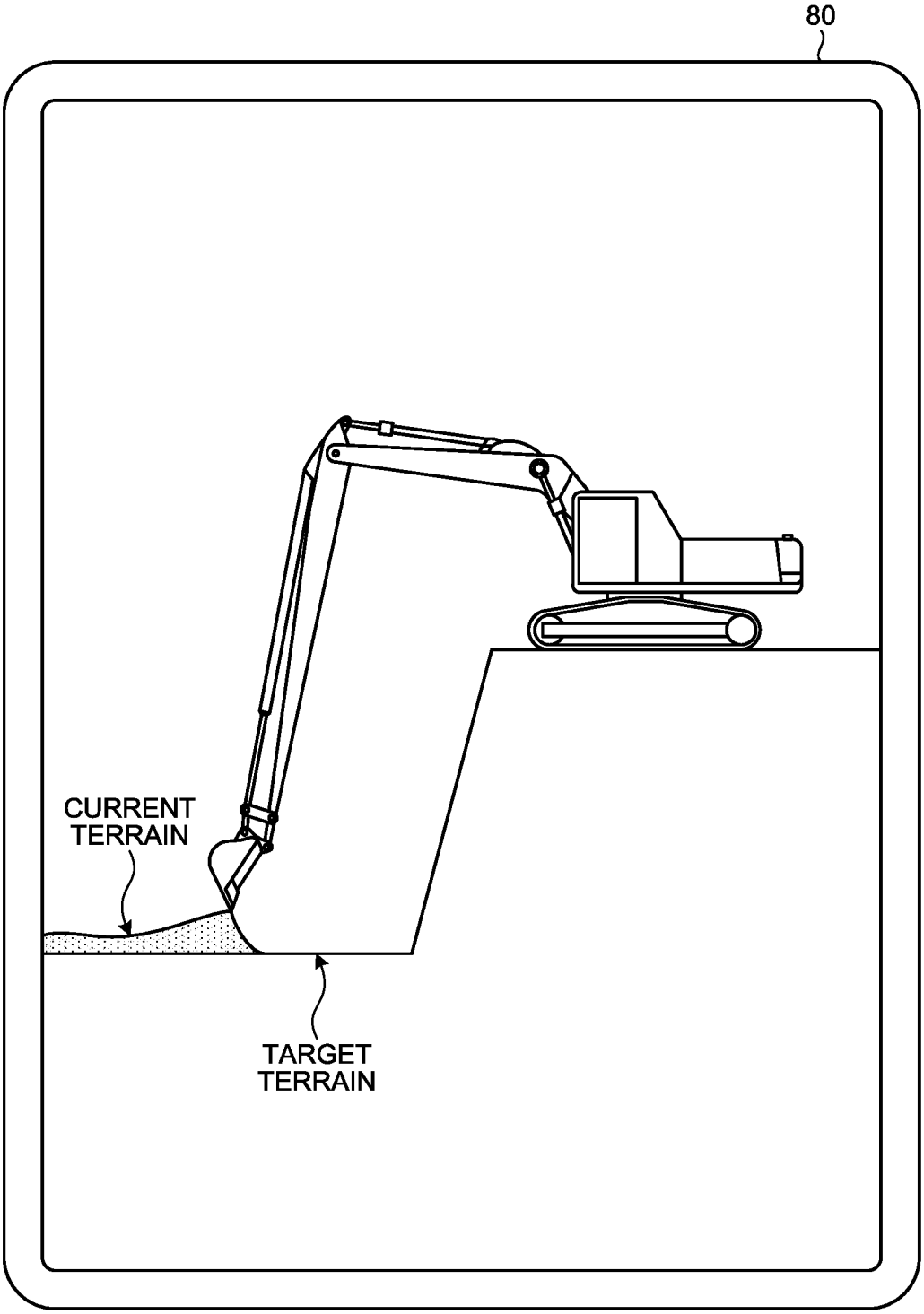
FIG. 13 is a schematic view illustrating an exemplary display device according to the first embodiment.

FIG. 13 is a schematic view illustrating an exemplary display device 80 when the dredging is performed, according to the present embodiment. As illustrated in FIG. 13, image data of a region through which the bucket 8 has passed, is sequentially deleted from image data indicating the current terrain on the display screen of the display device 80. The movement locus of the bucket 8 in the global coordinate system, can be calculated by the bucket position data calculation unit 53A. The current-terrain data generation unit 54 updates the current terrain data, on the basis of the position data of the working equipment 1 calculated by the bucket position data calculation unit 53A. The current-terrain data generation unit 54 determines the region through which the bucket 8 has passed, as a region from which the earth and sand of the current terrain have been removed, and updates the current terrain data. The current terrain data updated by the current-terrain data generation unit 54, is output to the display control unit 57. The display control unit 57 determines the region through which the bucket 8 has passed, as the region from which the earth and sand of the current terrain have been removed. The display control unit 57 deletes the image data of the region determined from which the earth and sand have been removed by the passing of the bucket 8, from the image data indicating the current terrain, on the basis of the position data (movement locus) of the bucket 8 calculated by the bucket position data calculation unit 53A. This arrangement enables the operator to visually check the progress of the dredging.

Function and Effect

As described above, according to the present embodiment, the current-terrain data is generated on the basis of the position data of the measurement points H of the bottom of water, and the target terrain data is generated from the generated current-terrain data. Thus, even in a situation in which the operator operating the excavator 100 has difficulty in visually observing the bottom of water during the dredging, the construction system 1000 can perform the ground-leveling assist control, on the basis of the target terrain data generated from the current terrain data. Therefore, the bottom of water is dredged with high precision.

In general, dredging is performed for the improvement and control of a river, the water depth securement of a harbor, or the like, and is often performed for the purpose of restoring, with removal of earth and sand depositing on a bottom of water, a state before the deposition of the earth and sand. The terrain of the bottom of water before the deposition of the earth and sand, is often unknown or uncertain. In the present embodiment, after the generation of the current terrain data, the target terrain data is generated on the basis of the current terrain data. Because the target terrain data is generated from the current terrain data, the target terrain data approximate to the terrain of the bottom of water before the deposition of the earth and sand, can be easily generated. For example, if target terrain data is arbitrarily generated with no current terrain data and then excavation is performed on the basis of the arbitrarily generated target terrain data, there is a possibility that a situation in which the bottom of water is excessively excavated, occurs, or a terrain deviating from the terrain of the bottom of water before the deposition of the earth and sand, is caused. In addition, if the terrain deviating from the terrain of the bottom of water before the deposition of the earth and sand, is caused, there is a possibility that collapse of a river bank or influence on environments occurs. According to the present embodiment, because the target terrain data is generated on the basis of the current terrain data and then the ground-leveling assist control is performed on the basis of the target terrain data, a terrain approximate to the terrain of the bottom of water before the deposition of the earth and sand, can be restored.

In addition, in the present embodiment, the position data of the measurement points H of the bottom of water is calculated from the position data of the blade edge 9 of the bucket 8 in contact with the bottom of water. This arrangement allows the position data of the measurements H of the bottom of water to be detected with high precision with the blade edge 9 of the bucket 8 in contact with the bottom of water by the operation of the operation device 30, even in the situation in which the operator operating the excavator 100 has difficulty in visually observing the bottom of water. The detection of the position data of the measurement points H of the bottom of water with high precision, enables the current-terrain data generation unit 54 to generate the current terrain data with high precision.

In addition, in the present embodiment, the target terrain data is generated on the basis of the position data of the deepest site Sm in the generated current terrain data. This arrangement inhibits the excavation of the bottom of water from being insufficient or the bottom of water from being excessively excavated, so that a target terrain approximate to the terrain of the bottom of water before the deposition of the earth and sand, can be generated.

In addition, according to the present embodiment, at least one of the current terrain data or the target terrain data is displayed on the display device 80. This arrangement enables the operator to visually check the current terrain generated by the current-terrain data generation unit 54 and the target terrain generated by the target-terrain data generation unit 55.

Note that, in the embodiment described above, the position data of the blade edge 9 of the bucket 8 in contact with the bottom of water is used as the position data of the measurement points H of the bottom of water. For example, the position data of the bottom of water may be detected on the basis of the position data of the external face of the bucket 8 in contact with the bottom of water. In addition, in a case where the working equipment 1 has no bucket 8, the position data of the bottom of water may be detected on the basis of the position data of at least a part of the working equipment 1 in contact with the bottom of water. The same is true for the following embodiments.

Second Embodiment

A second embodiment will be described. In the following description, constituent elements that are the same as or similar to those in the embodiment described above, are denoted with the same reference signs, and thus the descriptions thereof will be simplified or omitted.

Figure 14:
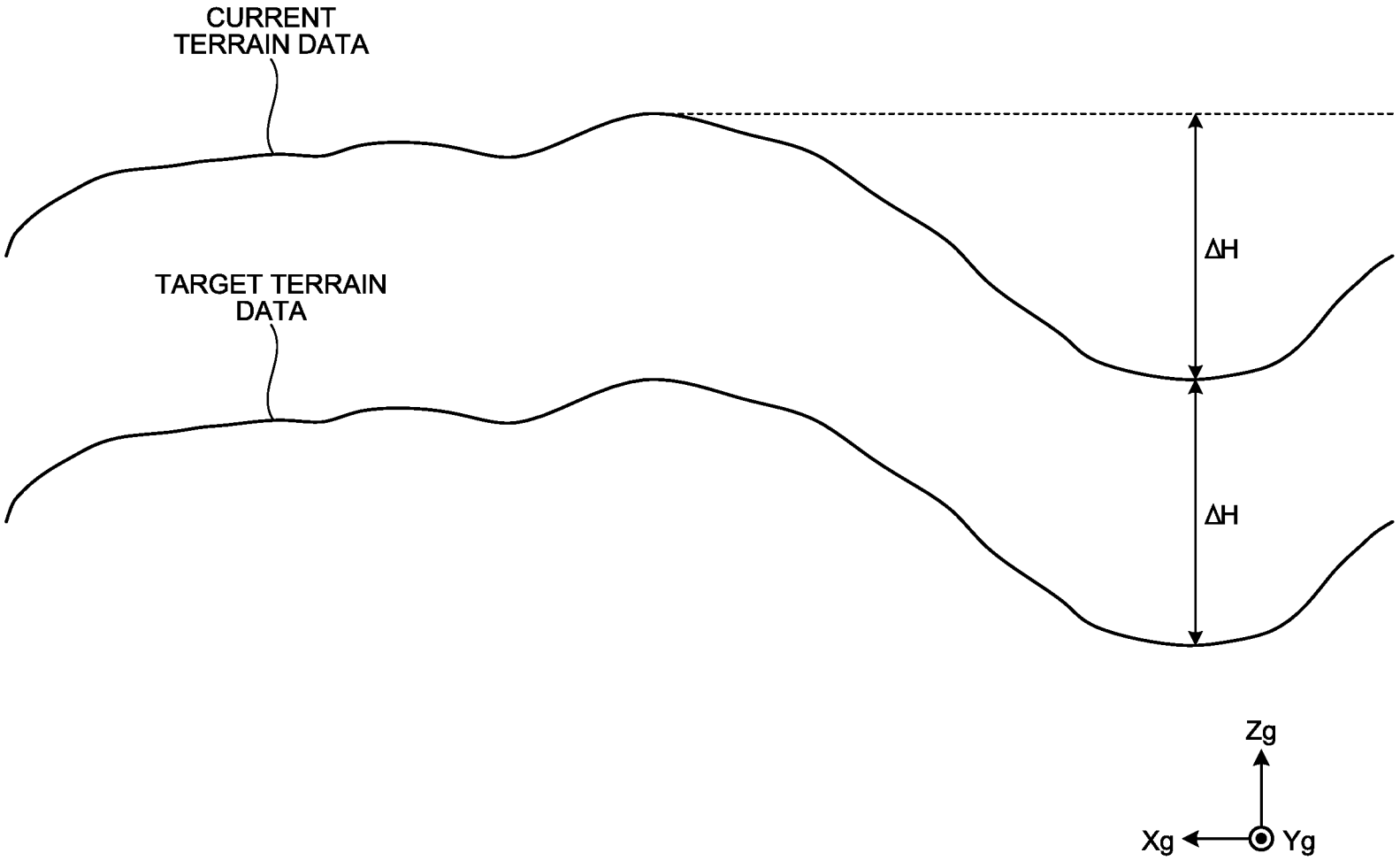
FIG. 14 is a schematic view illustrating an exemplary method of generating target terrain data of a bottom of water, according to a second embodiment.

In the present embodiment, an exemplary method of generating target terrain data for dredging of a bottom of water, will be described. FIG. 14 is a schematic view illustrating the exemplary method of generating the target terrain data of the bottom of water, according to the present embodiment.

Similarly to the embodiment described above, current terrain data is generated by a current-terrain data generation unit 54. In the present embodiment, a target-terrain data generation unit 55 offsets the current terrain data and generates the target terrain data. In other words, the target-terrain data generation unit 55 moves the current terrain data parallel in the −Zg direction, and generates the target terrain data. In the present embodiment, the target-terrain data generation unit 55 moves the current terrain data parallel in the −Zg direction by the different ΔH between position data of a deepest site and position data of a shallowest site in the current terrain data, and generates the target terrain data. On the basis of the target terrain data, a working equipment control unit 56 outputs a control signal such that a blade edge 9 of a bucket 8 moves along a target terrain.

As described above, according to the present embodiment, offsetting the current terrain data in the −Zg direction, generates the target terrain data. This arrangement can generate the target terrain approximate to the terrain of the bottom of water before deposition of earth and sand.

Third Embodiment

A third embodiment will be described. In the following description, constituent elements that are the same as or similar to those in the embodiments described above, are denoted with the same reference signs, and thus the descriptions thereof will be simplified or omitted.

Figure 15:
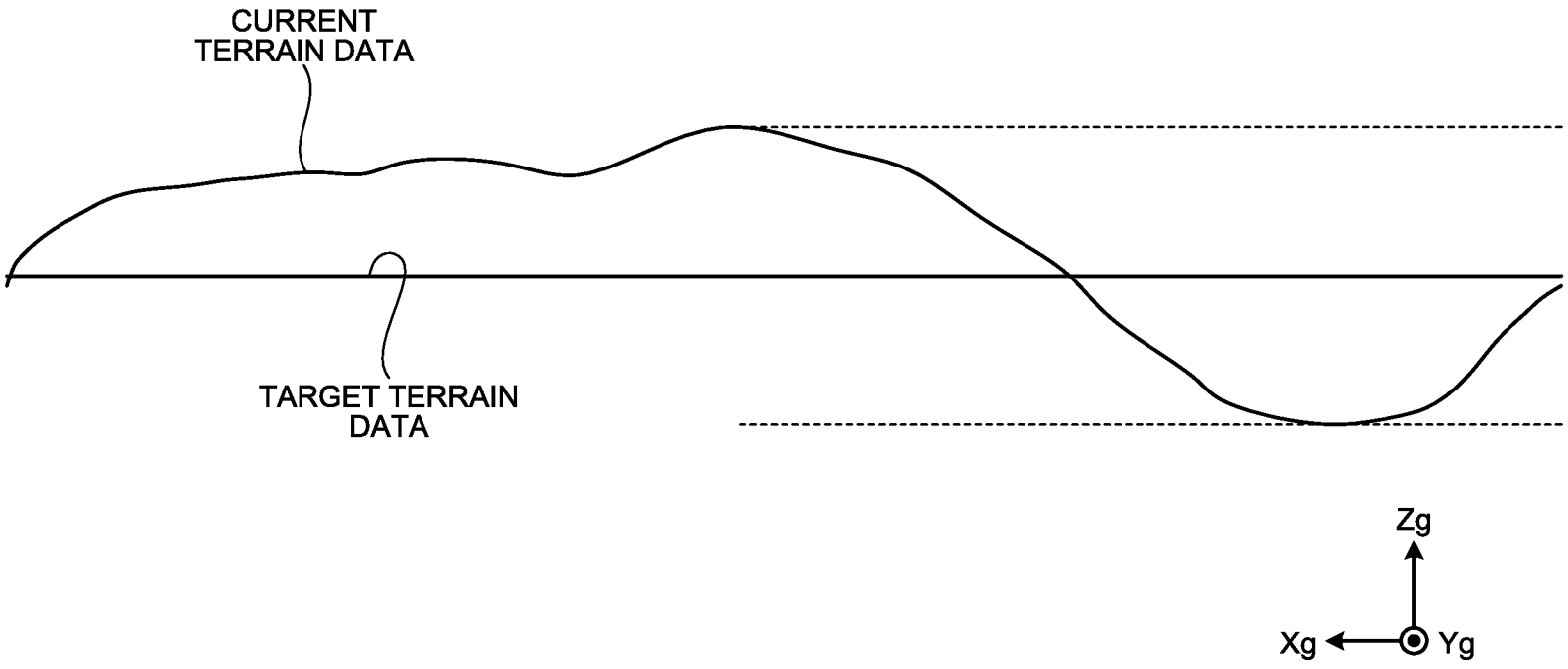
FIG. 15 is a schematic view illustrating an exemplary method of generating target terrain data of a bottom of water, according to a third embodiment.

In the present embodiment, an exemplary method of generating target terrain data for dredging of a bottom of water, will be described. FIG. 15 is a schematic view illustrating the exemplary method of generating the target terrain data of the bottom of water, according to the present embodiment.

Similarly to the embodiments described above, current terrain data is generated by a current-terrain data generation unit 54. In the present embodiment, a target-terrain data generation unit 55 generates the target terrain data, on the basis of position data of a site at a depth between a deepest site and a shallowest site in the current terrain data. That is, in the present embodiment, the target terrain data indicates a target terrain passing through a site at the intermediate depth between the deepest site and the shallowest site. The target terrain may be a plane that is parallel to a horizontal plane or inclines with respect to the horizontal plane, the plane passing through the site at the intermediate depth.

As described above, according to the present embodiment, the target terrain data is generated so as to pass through the site at the intermediate depth of the current terrain. This arrangement inhibits excavation of the bottom of water from being insufficient or the bottom of water from being excessively excavated, so that the target terrain approximate to the terrain of the bottom of water before deposition of earth and sand, can be generated.

Note that the target terrain is required at least to be prescribed at a depth between the deepest site and the shallowest site in the current terrain, and thus is not limited to the intermediate depth of the deepest site and the shallowest site. The target terrain is required at least to be prescribed at any depth between the deepest site and the shallowest site in the current terrain.

Fourth Embodiment

A fourth embodiment will be described. In the following description, constituent elements that are the same as or similar to those in the embodiments described above, are denoted with the same reference signs, and thus the descriptions thereof will be simplified or omitted.

Figure 16:
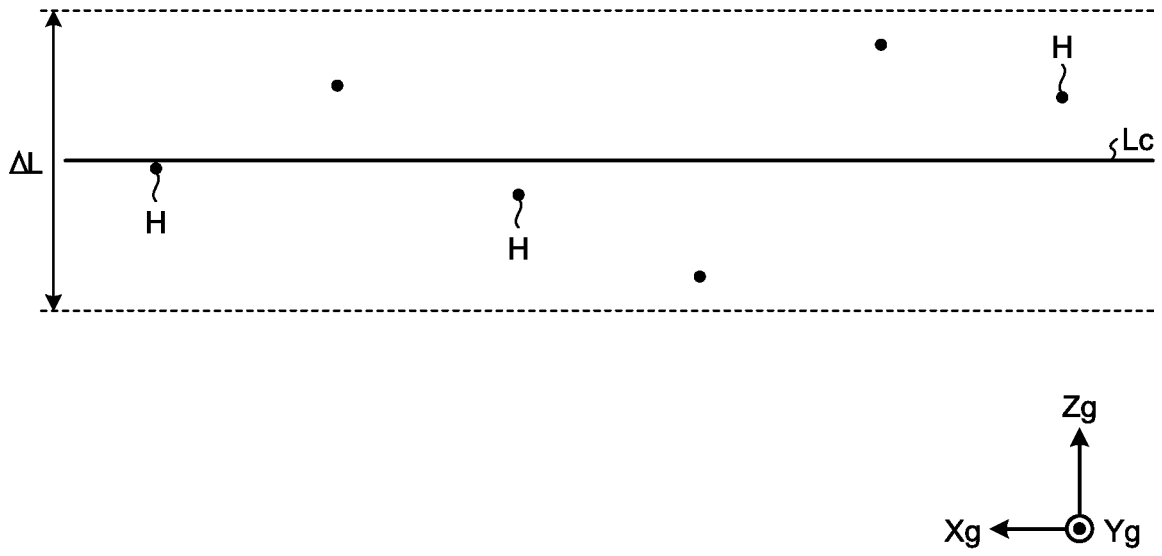
FIG. 16 is a schematic view illustrating an exemplary method of generating current terrain data of a bottom of water, according to a fourth embodiment.

In the present embodiment, an exemplary method of generating current terrain data of a bottom of water, will be described. FIG. 16 is a schematic view illustrating the exemplary method of generating the current terrain data of the bottom of water, according to the present embodiment.

Position data of a plurality of measurement points H of the bottom of water, is acquired with a blade edge 9 of a bucket 8. If the difference between deepest position data and shallowest position data in the plurality of measurement points H, is a threshold value ΔL or less, a current-terrain data generation unit 55 generates, as the current terrain data, a plane Lc passing at the average depth of the plurality of measurement points H.

As described above, according to the present embodiment, the generation load of the current terrain data can be reduced.

Note that, in the embodiment described above, the current terrain data is generated on the basis of the position data of the plurality of measurement points H. The current terrain data may be generated on the basis of the position data of one measurement point H. For example, the current terrain data may be a plane that passes through the one measurement point H and is parallel to a horizontal plane.

Fifth Embodiment

A fifth embodiment will be described. In the following description, constituent elements that are the same as or similar to those in the embodiments described above, are denoted with the same reference signs, and thus the descriptions thereof will be simplified or omitted.

The example in which the current terrain data is generated on the basis of the position data of the blade edge 9 of the bucket 8, has been described in the embodiments described above. In the present embodiment, an example in which current terrain data is generated on the basis of detection data of a detection device 600 capable of detecting a bottom of water in a non-contact manner, will be described.

Figure 17:
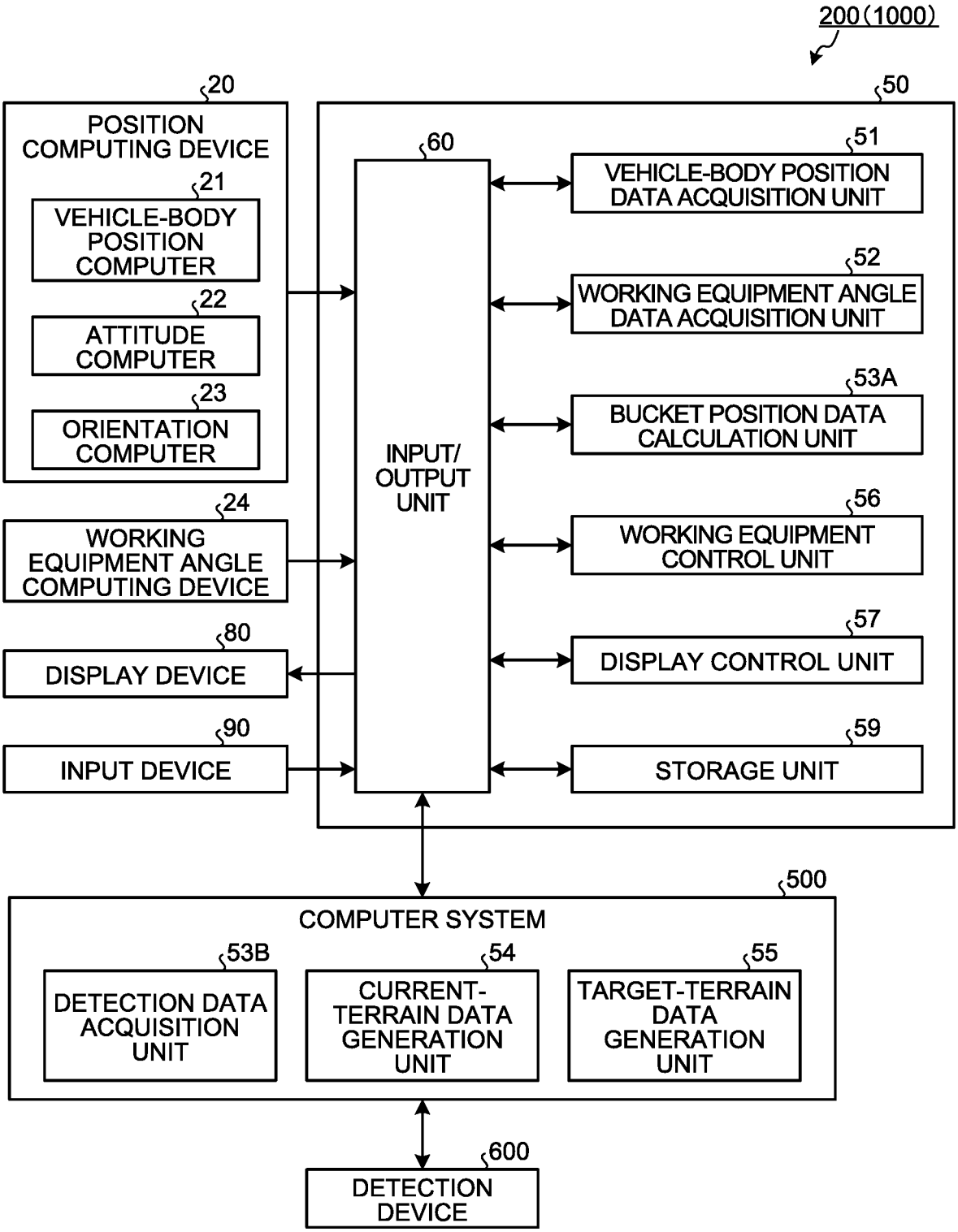
FIG. 17 is a functional block diagram illustrating an exemplary construction system according to a fifth embodiment.

FIG. 17 is a functional block diagram illustrating an exemplary construction system 1000 according to the present embodiment. As illustrated in FIG. 17, a control device 50 of an excavator 100 is capable of performing data communication with a computer system 500 that functions as a server. The control device 50 functions as a client. The data communication may be performed by wireless or by wire between the control device 50 and the computer system 500.

The detection device 600 detects position data of the bottom of water in a non-contact manner, and transmits the detection data to the computer system 500 in wireless. Note that the detection device 600 may transmit the detection data to the computer system 500 by wire.

In the present embodiment, the computer system 500 has a detection data acquisition unit 53B that acquires the detection data of the detection device 600. In the present embodiment, the detection data acquisition unit 53B functions as a position-data acquisition unit that acquires the position data of the bottom of water. In addition, the computer system 500 has: a current-terrain data generation unit 54 that generates the current terrain data of the bottom of water, on the basis of the detection data of the detection device 600; and a target-terrain data generation unit 55 that generates target terrain data for dredging of the bottom of water, on the basis of the current terrain data.

Figure 18:
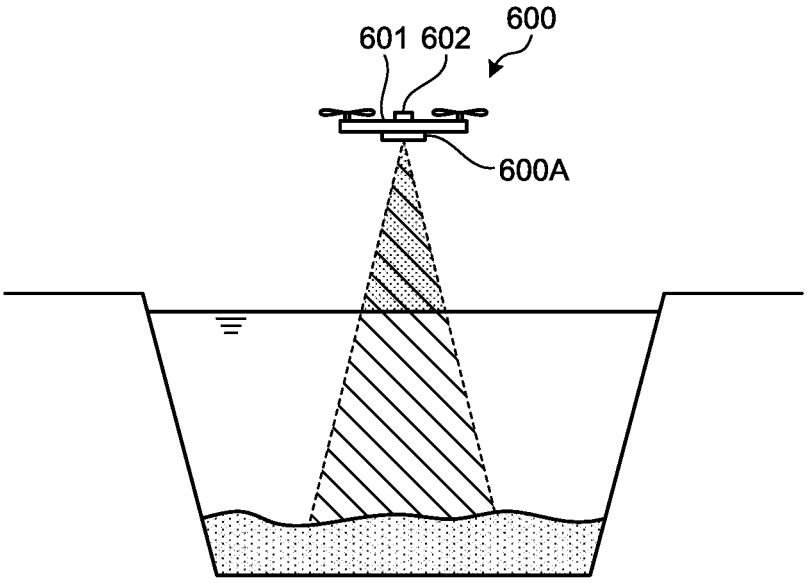
FIG. 18 is a schematic view illustrating an exemplary detection device according to the fifth embodiment.

FIG. 18 is a schematic view illustrating an exemplary detection device 600 according to the present embodiment. As illustrated in FIG. 18, the detection device 600 includes a laser range device 600A mounted on a drone 601 that is an flying object flying above a water surface, the laser range device 600A irradiating the bottom of water with laser light from above the water surface to detect the distance from the bottom of water. The drone 601 has a position computer 602 including a GPS receiver, mounted thereon. The position computer 602 calculates the position of the drone 601 and the position of the laser range device 600A in the global coordinate system. The laser range device 600A is capable of detecting the relative distance or the relative position between the laser range device 600A and a measurement point of the bottom of water. Detection data of the laser range device 600A and detection data of the position computer 602 are transmitted to the computer system 500. The computer system 500 is capable of calculating the position data indicating the absolute position of the bottom of water, on the basis of the relative position between the laser range device 600A and the bottom of water detected by the laser range device 600A and the absolute position of the laser range device 600A detected by the position computer 602.

Figure 19:
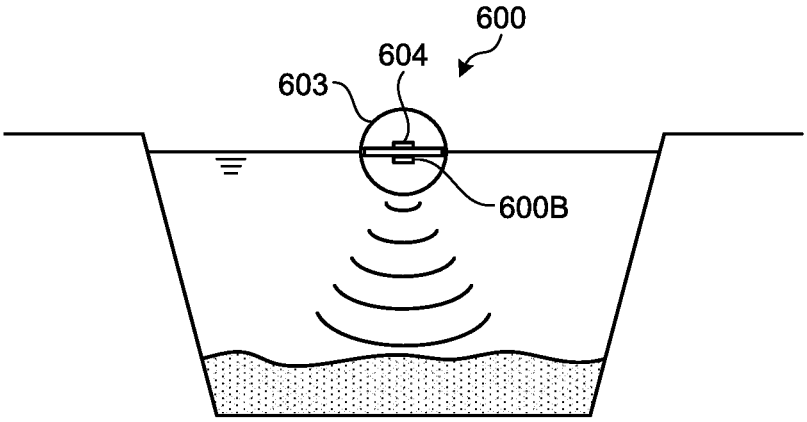
FIG. 19 is a schematic view illustrating an exemplary detection device according to the fifth embodiment.

FIG. 19 is a schematic view illustrating an exemplary detection device 600 according to the present embodiment. As illustrated in FIG. 19, the detection device 600 includes a sonar range device 600B mounted on a floating object 603 floating on a water surface, the sonar range device 600B irradiating the bottom of water with a sonic wave to detect the distance from the bottom of water. The floating object 603 has a position computer 604 including a GPS receiver, mounted thereon. The position computer 604 calculates the position of the floating object 603 and the position of the sonar range device 600B in the global coordinate system. The sonar range device 600B is capable of detecting the relative distance or the relative position between the sonar range device 600B and a measurement point of the bottom of water. Detection data of the sonar range device 600B and detection data of the position computer 604 are transmitted to the computer system 500. The computer system 500 is capable of calculating the position data indicating the absolute position of the bottom of water, on the basis of the relative position between the sonar range device 600B and the bottom of water detected by the sonar range device 600B and the absolute position of the sonar range device 600B detected by the position computer 604.

Note that the detection device 600 is required at least to be capable of detecting the position data of the bottom of water in a non-contact manner, and thus may be at least one of a laser scanner device, an acoustic camera device, a stereo camera device, and a sonar device disposed in water.

As illustrated in FIG. 17, the detection data acquisition unit 53B acquires the detection data of the detection device 600. The current-terrain data generation unit 54 of the computer system 500, generates the current terrain data, on the basis of the position data of the bottom of water detected by the detection device 600. The target-terrain data generation unit 55 of the computer system 500 generates the target terrain data.

In the present embodiment, the target-terrain data generation unit 55 may generate the target terrain data on the basis of the current terrain data or may generate the target terrain data without the current terrain data. For example, the target-terrain data generation unit 55 may generate the target terrain data, on the basis of design data created by, for example, a construction company.

The current terrain data and the target terrain data are transmitted from the computer system 500 to the control device 50. On the basis of the target terrain data transmitted from the computer system 500, a working equipment control unit 56 of the control device 50 outputs a control signal such that a working equipment 1 of the excavator 100 dredges the bottom of water. A display control unit 57 outputs a display signal for causing a display device 80 to display at least one of the current terrain data or the target terrain data.

As described above, according to the present embodiment, separately from the excavator 100, the detection device 600 detects the position data of the bottom of water, and then the current terrain data is generated on the basis of the detection data of the detection device 600. This arrangement enables the detection device 600 to acquire the current terrain data even in a situation in which an operator operating the excavator 100 has difficulty in visually observing the bottom of water.

In addition, in the present embodiment, at least one of the current terrain data or the target terrain data is displayed on the display device 80. This arrangement enables the operator to visually check the current terrain generated by the current-terrain data generation unit 54 and the target terrain generated by the target-terrain data generation unit 55.

In addition, in the present embodiment, the current-terrain data generation unit 54 and the target-terrain data generation unit 55 are provided in the computer system 500 that functions as the server. This arrangement enables the computer system 500 to distribute the current terrain data and the target terrain data to each of a plurality of excavators 100 that functions as a client.

Note that, in the present embodiment, the current-terrain data generation unit 54 and the target-terrain data generation unit 55 may be provided in the excavator 100. The detection data of the detection device 600 may be directly transmitted to the control device 50 of the excavator 100 without the computer system 500.

Note that, in the embodiment described above, when position data of measurement points H is acquired, the operator operates an input device 90 with the working equipment 1 stopped with a blade edge 9 of a bucket 8 in contact with the bottom of water, so that the position data of the measurement points H is acquired. For example, the position data of the measurement points H of the bottom of water may be automatically acquired with, as a trigger, impulse that occurs due to a touch of the blade edge 9 of the bucket 8 to the bottom of water or pressure that operates to a hydraulic system of the working equipment 1.

Note that, in the embodiment described above, the work vehicle 100 is the excavator. As far as being capable of performing dredging, the work vehicle 100 is not limited to the excavator.

REFERENCE SINGS LIST

1 WORKING EQUIPMENT
2 UPPER SWING BODY
3 LOWER TRAVELING BODY
3C CRAWLER TRACK
4 CAB
5 MACHINE ROOM
6 BOOM
7 ARM
8 BUCKET
9 BLADE EDGE
10 HYDRAULIC CYLINDER
11 BOOM CYLINDER
12 ARM CYLINDER
13 BUCKET CYLINDER
16 BOOM STROKE SENSOR
17 ARM STROKE SENSOR
18 BUCKET STROKE SENSOR
20 POSITION COMPUTING DEVICE
21 VEHICLE-BODY POSITION COMPUTER
21A GPS ANTENNA
22 ATTITUDE COMPUTER
23 ORIENTATION COMPUTER
24 WORKING EQUIPMENT ANGLE COMPUTING DEVICE
30 OPERATION DEVICE
50 CONTROL DEVICE
51 VEHICLE-BODY POSITION DATA ACQUISITION UNIT
52 WORKING EQUIPMENT ANGLE DATA ACQUISITION UNIT
53A BUCKET POSITION DATA CALCULATION UNIT

53B DETECTION DATA ACQUISITION UNIT
54 CURRENT-TERRAIN DATA GENERATION UNIT
55 TARGET-TERRAIN DATA GENERATION UNIT
56 WORKING EQUIPMENT CONTROL UNIT
57 DISPLAY CONTROL UNIT
59 STORAGE UNIT
60 INPUT/OUTPUT UNIT
80 DISPLAY DEVICE
90 INPUT DEVICE
100 EXCAVATOR (WORK VEHICLE)
200 CONTROL SYSTEM
400 DETECTION SYSTEM
500 COMPUTER SYSTEM
600 DETECTION DEVICE
600A LASER RANGE DEVICE
601 DRONE (FLYING OBJECT)
602 POSITION COMPUTER
600B SONAR RANGE DEVICE
603 FLOATING OBJECT
604 POSITION COMPUTER
1000 CONSTRUCTION SYSTEM
$\alpha\alpha$ BOOM ANGLE
$\beta$ ARM ANGLE
$\gamma$ BUCKET ANGLE
$\theta$1 ROLL ANGLE
$\theta$2 PITCH ANGLE
$\theta$3 YAW ANGLE

The invention claimed is:

1. A construction system comprising:

a position data acquisition unit configured to acquire position data of a bottom of water indicating an absolute position of a measurement point of the bottom of water by calculating position data of a working equipment of a work vehicle when a blade edge of the working equipment is in contact with the measurement point of the bottom of water;

a current-terrain data generation unit configured to generate current terrain data of a current shape of an area of the bottom of water, based on the position data;

a target-terrain data generation unit configured to generate target terrain data of the area of the bottom of water, according to the current shape of the area of the bottom of water from the current terrain data, the target terrain data being target terrain data for dredging of the area of the bottom of water, indicating the target shape of the area of the bottom of water after the dredging; and a working equipment control unit configured to control the working equipment of the work vehicle such that the working equipment dredges the area of the bottom of water, based on the target terrain data.

2. The construction system according to claim 1, wherein the position data includes position data of the working equipment when at least a part of the working equipment is in contact with the bottom of water.

3. The construction system according to claim 1, wherein the target-terrain data generation unit is configured to generate the target terrain data based on position data of a deepest site in the current terrain data.

4. The construction system according to claim 1, wherein the target-terrain data generation unit is configured to offset the current terrain data to generate the target terrain data.

5. The construction system according to claim 1, wherein the target-terrain data generation unit is configured to generate the target terrain data based on position data of a site at a depth between a deepest site and a shallowest site in the current terrain data.

6. The construction system according to claim 1, wherein the position data includes detection data of a detection device configured to detect the bottom of water in a non-contact manner.

7. The construction system according to claim 1, further comprising: a display control unit configured to output a display signal to cause a display device to display at least one of the current terrain data and the target terrain data.

8. The construction system according to claim 1, wherein the current-terrain data generation unit is configured to update the current terrain data based on position data of the working equipment.

9. The construction system according to claim 1, wherein the target terrain data is directly generated from at least the current terrain data.

10. The construction system according to claim 1, wherein the current terrain data of the area comprises a swing area of the working equipment of the work vehicle.

11. The construction system according to claim 1, wherein the working equipment is controlled to perform a ground-leveling assist control based on the target terrain data.

12. A construction method comprising:

acquiring position data of a bottom of water indicating an absolute position of a measurement point of the bottom of water by calculating position data of a working equipment of a work vehicle when a blade edge of the working equipment is in contact with the measurement point of the bottom of water;

generating current terrain data of a current shape of an area of the bottom of water based on the position data;

generating target terrain data of the area of the bottom of water according to the current shape of the area of the bottom of water from the current terrain data, the target terrain data being target terrain data for dredging of the area of the bottom of water, indicating the target shape of the area of the bottom of water after the dredging; and controlling the working equipment of the work vehicle such that the working equipment dredges the area of the bottom of water, based on the target terrain data.

* * * * *